US009475209B2

(12) United States Patent
Nakamoto et al.

(10) Patent No.: US 9,475,209 B2
(45) Date of Patent: Oct. 25, 2016

(54) WIRE SAW AND WORKPIECE MACHINING METHOD EMPLOYING SAME

(71) Applicant: Komatsu NTC Ltd., Nanto, Toyama (JP)

(72) Inventors: Hiroshi Nakamoto, Nanto (JP); Tomoyuki Kawatsu, Nanto (JP); Satoshi Ishizuka, Nanto (JP); Akinori Himata, Nanto (JP); Takafumi Satake, Nanto (JP)

(73) Assignee: KOMATSU NTC LTD., Nanto, Toyama (JP)

( * ) Notice: Subject to any disclaimer, the term of this patent is extended or adjusted under 35 U.S.C. 154(b) by 45 days.

(21) Appl. No.: 14/413,187

(22) PCT Filed: Jul. 2, 2013

(86) PCT No.: PCT/JP2013/068113

§ 371 (c)(1),
(2) Date: Jan. 6, 2015

(87) PCT Pub. No.: WO2014/010468

PCT Pub. Date: Jan. 16, 2014

(65) Prior Publication Data

US 2015/0202797 A1 Jul. 23, 2015

(30) Foreign Application Priority Data

Jul. 10, 2012 (JP) ..... 2012-154784

(51) Int. Cl.
*B28D 1/08* (2006.01)
*B24B 27/06* (2006.01)
(Continued)

(52) U.S. Cl.
CPC ..... *B28D 1/08* (2013.01); *B24B 27/0633* (2013.01); *B24B 41/06* (2013.01); *B28D 5/0082* (2013.01); *B28D 5/045* (2013.01)

(58) Field of Classification Search
CPC ..... B28D 1/08; B28D 5/0082; B28D 5/045; B28D 1/045; B28D 1/047; B28D 1/547; B24B 27/0633; B24B 37/345; B24B 41/005
USPC ..... 125/13.01, 21; 451/336–337, 339, 451; 83/651.1
See application file for complete search history.

(56) References Cited

U.S. PATENT DOCUMENTS 4,436,078 A * 3/1984 Bourke ..... B28D 1/003 125/13.01
4,699,564 A * 10/1987 Cetrangolo ..... B65G 47/248 125/35

(Continued)

FOREIGN PATENT DOCUMENTS

CN 101670544 3/2010
JP 05-024034 A 2/1993

(Continued)

OTHER PUBLICATIONS

Japanese Office Action with English-language machine translation pertaining to Japanese Application No. 2012-154784 (Jan. 25, 2016).

(Continued)

*Primary Examiner* — George Nguyen
(74) *Attorney, Agent, or Firm* — Marsh Fischmann & Breyfogle LLP

(57) ABSTRACT

Provided is a wire saw where a wire (47) extends and is wound around a plurality of machining rollers (45), the wire (47) is moved in a circulating manner around the machining rollers (45) due to rotation of the machining rollers (45), and a workpiece (49) is cut by the wire (47) at a workpiece cutting position. The wire saw includes a supply pallet (67) which guides the workpiece (49) to move toward the wire (47) at the workpiece cutting position in an upright state. The wire saw also includes a receiving pallet (100) which is arranged at a workpiece receiving position located downstream of the workpiece cutting position in the workpiece conveying direction, and receives the cut workpiece (49) with the workpiece (49) being kept in an upright state.

21 Claims, 15 Drawing Sheets

(51) Int. Cl.

| | |
|---|---|
| ***B24B 41/06*** | (2012.01) |
| ***B28D 5/00*** | (2006.01) |
| ***B28D 5/04*** | (2006.01) |

(56) References Cited

U.S. PATENT DOCUMENTS

| | | | | |
|---|---|---|---|---|
| 4,967,725 | A * | 11/1990 | Hinzen | B24B 7/228 125/21 |
| 5,056,272 | A * | 10/1991 | Battaglia | B24B 7/06 125/13.01 |
| 5,243,960 | A * | 9/1993 | Myles | B28D 1/005 125/21 |
| 5,950,643 | A * | 9/1999 | Miyazaki | B28D 5/0076 134/201 |
| 6,067,976 | A * | 5/2000 | Katayama | B28D 5/045 125/16.02 |
| 6,098,610 | A * | 8/2000 | Egglhuber | B23D 57/0053 125/16.01 |
| 6,135,102 | A * | 10/2000 | Sorimachi | B28D 5/0082 125/16.02 |
| 6,135,103 | A * | 10/2000 | Katamachi | B23D 57/0046 125/16.02 |
| 6,139,591 | A * | 10/2000 | Nakaura | B28D 5/0082 29/25.01 |
| 6,145,499 | A * | 11/2000 | Tsuchishima | B28D 5/045 125/21 |
| 6,279,564 | B1 * | 8/2001 | Hodsden | B23D 57/0046 125/16.01 |
| 6,520,061 | B2 * | 2/2003 | Fukuta | B23D 57/0007 125/16.02 |
| 6,772,749 | B2 * | 8/2004 | Heydt | B23D 53/04 125/12 |
| 6,941,940 | B1 * | 9/2005 | Zavattari | B23D 57/0061 125/16.02 |
| 7,503,831 | B2 * | 3/2009 | Radkevich | B23D 57/0061 125/16.02 |
| 8,028,686 | B2 * | 10/2011 | Gomez | B28D 1/005 125/13.01 |
| 8,065,995 | B2 * | 11/2011 | Bakshi | B28D 5/0076 125/16.01 |
| 2002/0077052 | A1 * | 6/2002 | Grund | B23Q 11/0816 451/451 |
| 2003/0145844 | A1 * | 8/2003 | Lukschandel | B23Q 1/38 125/16.02 |
| 2004/0244788 | A1 * | 12/2004 | Register | B28D 1/048 125/13.01 |
| 2004/0255924 | A1 | 12/2004 | Kondo et al. | |
| 2005/0020197 | A1 * | 1/2005 | Wakazono | B23Q 11/08 451/451 |
| 2005/0087181 | A1 * | 4/2005 | Wille | B28D 5/045 125/21 |
| 2005/0183713 | A1 * | 8/2005 | Takeuchi | B28D 5/045 125/21 |
| 2006/0249134 | A1 * | 11/2006 | Kawasaki | B24B 27/0633 125/21 |
| 2007/0228630 | A1 * | 10/2007 | Grundmuller | B23K 26/10 269/71 |
| 2009/0084373 | A1 * | 4/2009 | Oishi | B28D 5/045 125/20 |
| 2009/0145415 | A1 * | 6/2009 | Spurgeon | B44C 1/26 125/13.01 |
| 2009/0288651 | A1 * | 11/2009 | Brocco | B23D 57/0053 125/21 |
| 2013/0121802 | A1 * | 5/2013 | Albrecht | H01L 21/68 414/809 |
| 2013/0175242 | A1 * | 7/2013 | Lancaster-Larocque | H01F 41/0253 219/69.12 |
| 2015/0202797 | A1 * | 7/2015 | Nakamoto | B24B 27/0633 125/21 |

FOREIGN PATENT DOCUMENTS

| | | | |
|---|---|---|---|
| JP | 07-308917 | A | 11/1995 |
| JP | H9123162 | | 5/1997 |
| JP | 11-129152 | A | 5/1999 |
| JP | 11-165250 | A | 6/1999 |
| JP | 11-188600 | A | 7/1999 |
| JP | 11-188601 | A | 7/1999 |
| JP | 2000-271848 | A | 10/2000 |
| JP | 2000-326324 | A | 11/2000 |
| JP | 2002-264003 | A | 9/2002 |
| JP | 2003-275950 | A | 9/2003 |
| JP | CN1466505 | A | 1/2004 |
| JP | 2006-082173 | A | 3/2006 |
| JP | 2010-023225 | A | 2/2010 |
| JP | 2010-149248 | A | 7/2010 |
| JP | 2010-253612 | A | 11/2010 |
| JP | 2011-143510 | A | 7/2011 |
| JP | 2011-212781 | A | 10/2011 |

OTHER PUBLICATIONS

International Preliminary Report on Patentability dated Jan. 13, 2015, PCT Application No. PCT/JP2013/068113, filed Jul. 2, 2013.

Japanese Office Action with English-language machine translation pertaining to Japanese Application No. 2012-154784 (Jun. 7, 2016).

Office Action received from Chinese Patent Office in related Chinese Application No. 201380036364.9. (Feb. 3, 2016).

International Search Report dated Aug. 13, 2013, PCT International Application No. PCT/JP2013/068113, filed Jul. 2, 2013.

* cited by examiner

WIRE SAW AND WORKPIECE MACHINING METHOD EMPLOYING SAME

FIELD OF THE INVENTION

The present invention relates to a wire saw, which applies cutting by a wire to a workpiece made of a brittle material such as a semiconductor material, a magnetic material or a ceramic material, and a workpiece machining method using such a wire saw. The present invention particularly relates to a wire saw and a workpiece machining method suitable for cutting a plate-shaped workpiece into slices.

BACKGROUND OF THE INVENTION

Conventionally, this type of wire saw is disclosed in patent documents 1 and 2. The conventional wire saw described in patent documents 1 and 2 has four pieces of or a pair of machining rollers extending parallel to each other along the horizontal direction, and each machining roller is rotatable about an axis thereof. A plurality of annular grooves is formed on an outer periphery of each machining roller, and a wire is wound around the machining roller along these annular grooves. The wire saw includes a conveying device that has a movable body. The movable body can be elevated or lowered such that the movable body selectively approaches or moves away from the wire extending between a pair of machining rollers arranged on an upper side. A workpiece, which is adhered to a plate, is held on the movable body.

Due to the rotation of the machining rollers, the movable body of the conveying device is moved in the machining conveying direction while the wire is moved in a circulating manner. Accordingly, the workpiece is moved toward the wire extending between the machining rollers, and the workpiece is cut into slices by the wire. Further, by moving the movable body of the conveying device such that the movable body returns in the direction opposite to the machining conveying direction after the workpiece is cut, the workpiece after cutting is moved to be away from the wire and hence, the wire is conveyed out to the outside from the inside of a circulating region where the wire is moved in a circulating manner.

PRIOR ART DOCUMENTS

Patent Documents

Patent document 1: Japanese Laid-open Patent Publication No. 2003-275950

Patent document 2: Japanese Laid-open Patent Publication No. 2010-149248

SUMMARY OF THE INVENTION

In such a conventional configuration, the workpiece after cutting is moved such that the workpiece returns in the direction opposite to the machining conveying direction and hence, there is a possibility that a cut surface of the workpiece will be brought into contact with the wire extending between the machining rollers whereby flaws will be generated on the workpiece.

Particularly, in the case where the workpiece is elongated along the machining conveying direction, when the workpiece, which is cut into slices, is brought into contact with the wire, there is a possibility that the workpiece will be broken.

Further, when the plate-shaped workpiece is cut into slices from a distal end thereof in the machining conveying direction, it is necessary to support the workpiece in a cantilever manner at a rear end in the machining conveying direction. Accordingly, the conveyance and the posture of the workpiece become unstable and hence, it is difficult to accurately cut the workpiece into slices such that the cut workpiece has a predetermined thickness and to smoothly remove the workpiece from the wire without damage.

The present invention has been made by focusing on the drawbacks present in such prior art. It is an object of the present invention to provide a wire saw that can easily and accurately cut a plate-shaped workpiece from a distal end thereof in the workpiece conveying direction and a workpiece machining method using such a wire saw.

To achieve the above-mentioned object, according to one aspect of the present invention, there is provided a wire saw where a wire extends and is wound around a plurality of machining rollers. The wire is moved in a circulating manner around the machining rollers due to the rotation of machining rollers, and a plate-shaped workpiece is cut by the wire at a workpiece cutting position. The wire saw includes a workpiece guide part, which guides the workpiece to move the workpiece toward the wire at the workpiece cutting position along a workpiece conveying direction in an upright state. The wire saw also includes a workpiece receiving part, which is arranged at a workpiece receiving position located downstream of the workpiece guide part in the workpiece conveying direction and receives the workpiece cut by the wire with the workpiece maintained in an upright state.

According to another aspect of the present invention, there is provided a method of machining a workpiece using a wire saw where a wire extends and is wound around a plurality of machining rollers. The wire is moved in a circulating manner around the machining rollers due to the rotation of the machining rollers, and a plate-shaped workpiece is cut by the wire at a workpiece cutting position. The method of machining a workpiece includes the steps of moving the workpiece toward the wire at the workpiece cutting position along a workpiece conveying direction in an upright state, cutting the workpiece by the wire, detaining the cut workpiece in an area inside a circulating region where the wire moves in a circulating manner while keeping the cut workpiece in an upright state and, thereafter, conveying the cut workpiece toward an outside position from the area inside the circulating region along an axial direction of the machining rollers.

Accordingly, in the present invention, the workpiece in an upright state is conveyed and moved toward the wire at the workpiece cutting position by the workpiece guide part, and the workpiece is cut from the distal end of the workpiece in the workpiece conveying direction by the wire. Then, the cut workpiece is received by the workpiece receiving part at the workpiece receiving position downstream in the workpiece conveying direction with the workpiece being kept in an upright state. Accordingly, the workpiece can be stably conveyed and moved toward the wire extending between the machining rollers without fixing the workpiece to the conveying device and, at the same time, the workpiece after cutting can be stably received so that an operation of fixing the workpiece to the movable body of the conveying device or an operation of removing the workpiece from the movable body of the conveying device become unnecessary.

Further, according to the wire saw of the present invention, the workpiece is not fixed to the movable body of the conveying device and hence, there is no possibility that the conveying device will be moved to return in the direction opposite to the workpiece conveying direction after the workpiece is cut. That is, unlike the conventional structure, there is no possibility that the cut workpiece will move again passing through the wire cutting position. Accordingly, it is possible to prevent the workpiece, which is already cut, from being brought into contact with the wire and generating flaws.

DETAILED DESCRIPTION OF THE PREFERRED EMBODIMENTS

Figure 1:
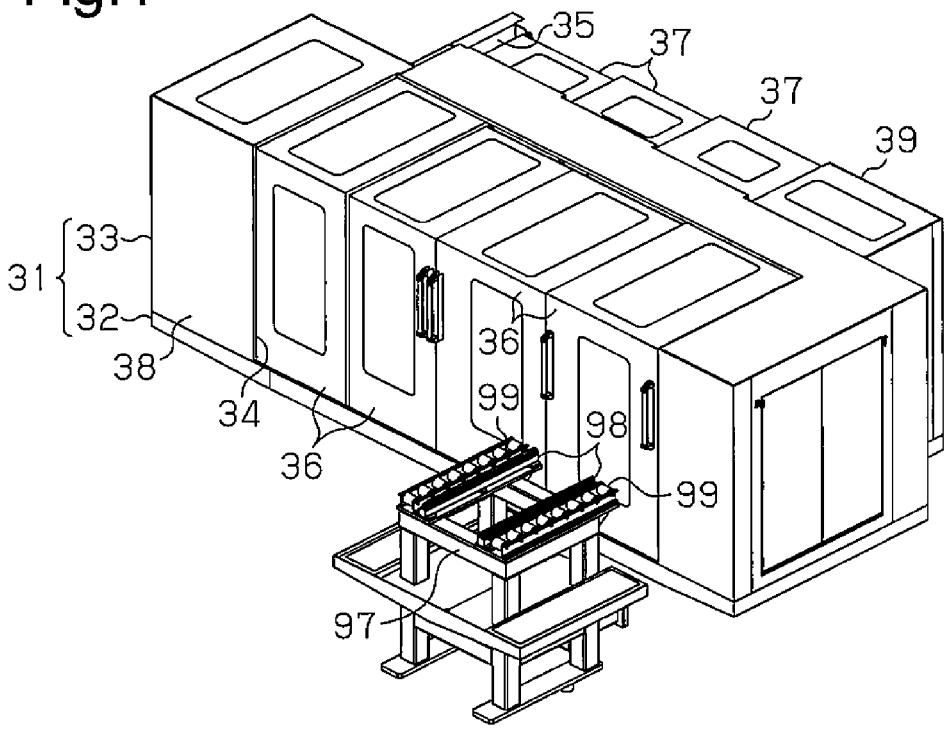
FIG. 1 is a perspective view showing the external appearance of the structure of a wire saw according to one embodiment of the present invention as viewed from a front side.
Figure 2:
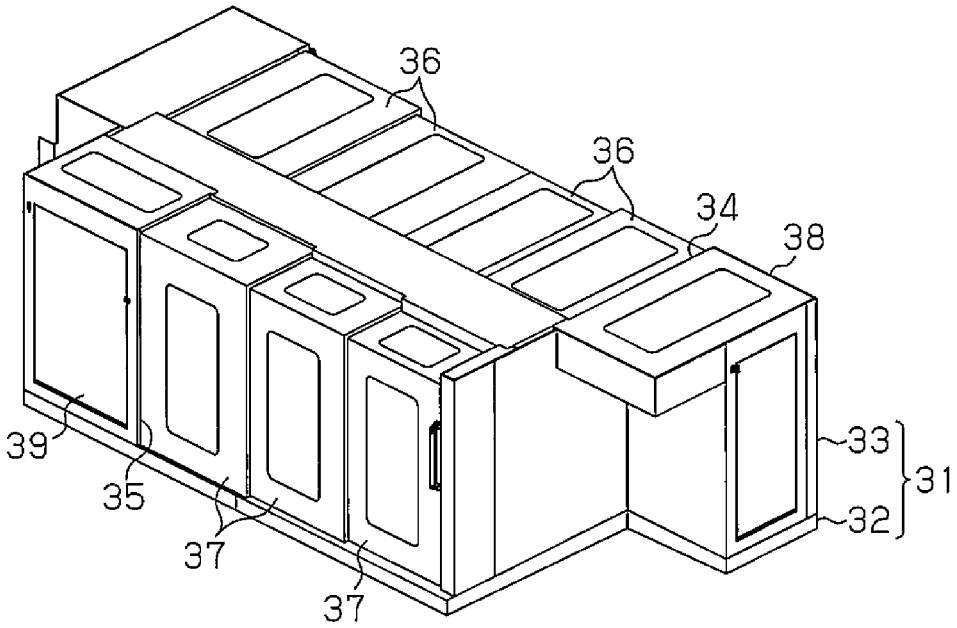
FIG. 2 is a perspective view showing the external appearance of the structure of the wire saw shown in FIG. 1 as viewed from a back side.

Hereinafter, a wire saw according to one embodiment of the present invention is described by reference to drawings.

As shown in FIGS. 1 to 4, the wire saw has a device frame 31, which includes a device base 32 and a device cover 33 located on the device base 32. A front opening 34 is formed in a front portion of an upper surface and a front surface of the device cover 33, and a rear opening 35 is formed in a rear portion of the upper surface and a rear surface of the device cover 33. A plurality of (four in this embodiment) front doors 36 having an approximately inverted-L-shaped cross sectional shape is mounted in the front opening 34 in a slidable manner between a position where the front doors 36 overlap with each other and a position where the front doors 36 are opened in the lateral direction. A plurality of (four in the embodiment) rear doors 37 having an approximately reverse-L-shaped cross-sectional shape is mounted in the rear opening 35 in a slidable manner between a position where the rear doors 37 overlap with each other and a position where the rear doors 37 are opened in the lateral direction. In this embodiment, a right side and a left side are, respectively, a right side and a left side in FIGS. 1 to 6, 17, 18 and the like.

Figure 3:
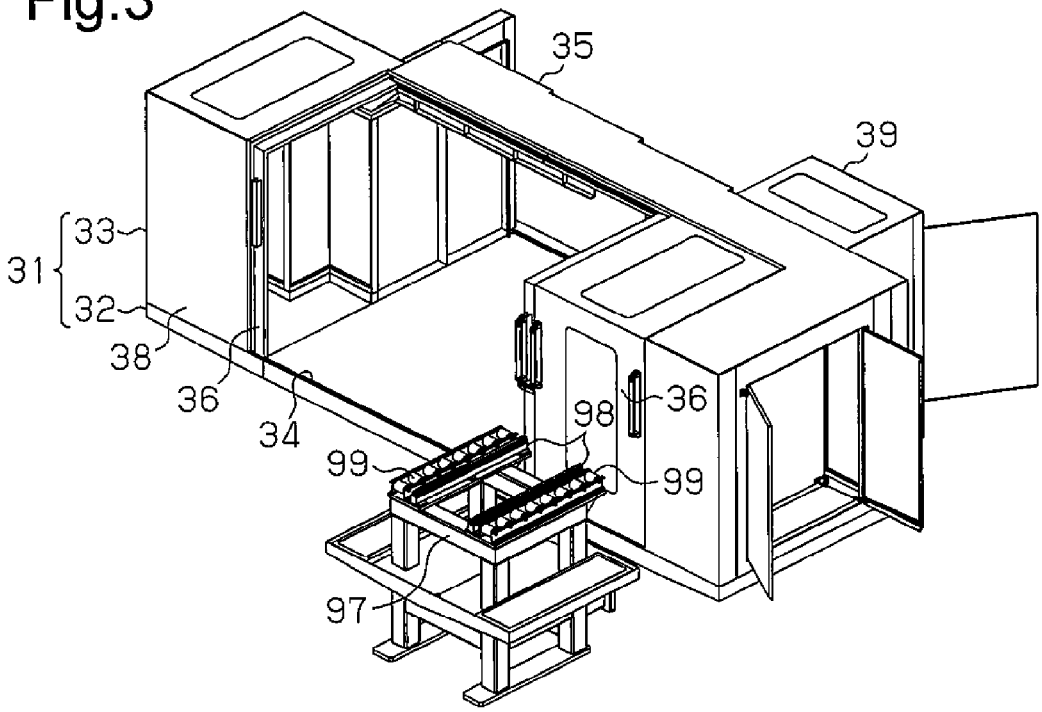
FIG. 3 is a perspective view showing the external appearance of the structure of the wire saw shown in FIG. 1 at the time of conveying-in a workpiece as viewed from a front side.
Figure 4:
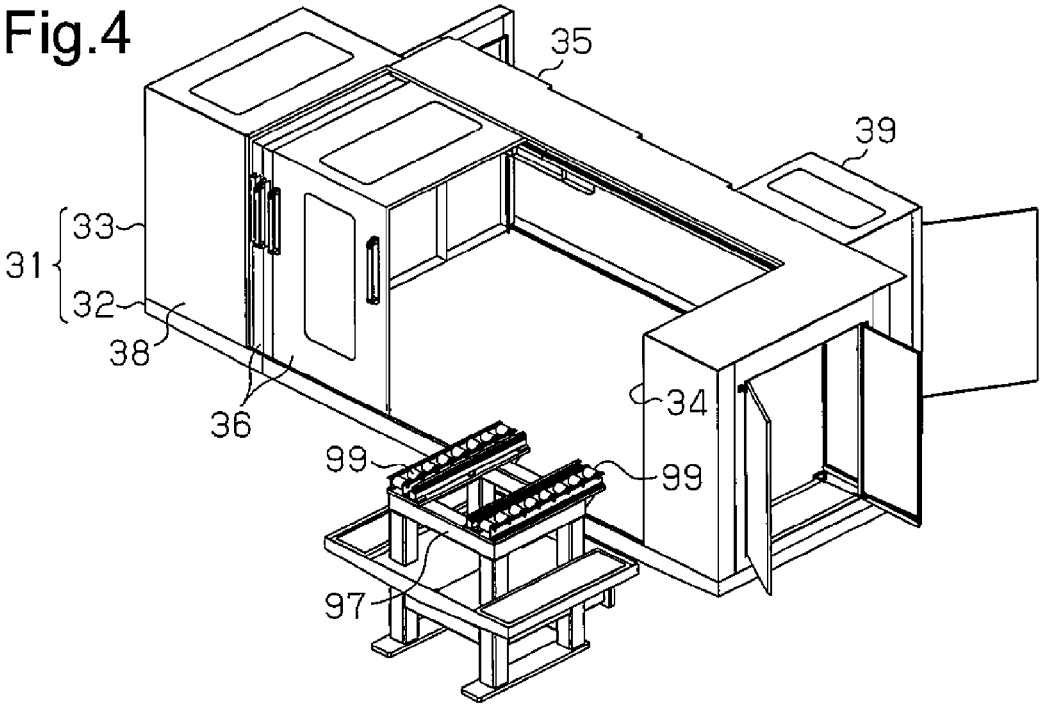
FIG. 4 is a perspective view showing the external appearance of the structure of the wire saw shown in FIG. 1 at the time of conveying-out a workpiece as viewed from a front side.
Figure 5:
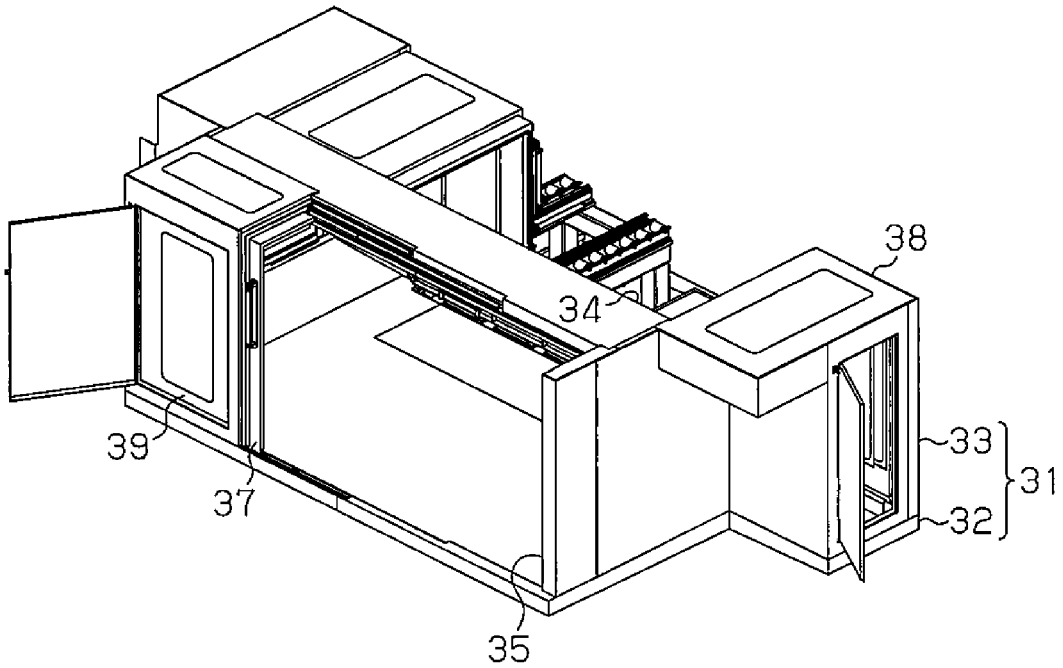
FIG. 5 is perspective view showing the external appearance of the structure of the wire saw shown in FIG. 1 at the time of mounting or dismounting a wire reel as viewed from a back side.

A plurality of plate-like workpieces 49 is conveyed into the device frame 31 in a non-machined state. The workpieces 49 are subjected to cutting in the device frame 31, and machined workpieces 49 are conveyed out from the device frame 31. A front door storing portion 38 is located at a left end portion of the device frame 31. As shown in FIG. 3, when the non-machined workpiece 49 is conveyed into the device frame 31, three front doors 36 on a left side are stored in the front door storing portion 38 in an overlapping manner, and a left portion of the front opening 34 is opened. As shown in FIG. 4, at the time of conveying the machined workpiece 49 from the inside of the device frame 31, three front doors 36 on a left side are stored in the front door storing portion 38, and one front door 36 on a right side is located on a left end position of the front opening 34 so that a right portion of the front opening 34 is opened. A rear door storing portion 39 is located on a right end portion of the device frame 31. As shown in FIG. 5, by storing all rear doors 37 in the rear door storing portion 39 located on the side end portion of the device frame 31, the whole rear opening 35 can be opened.

Figure 6:
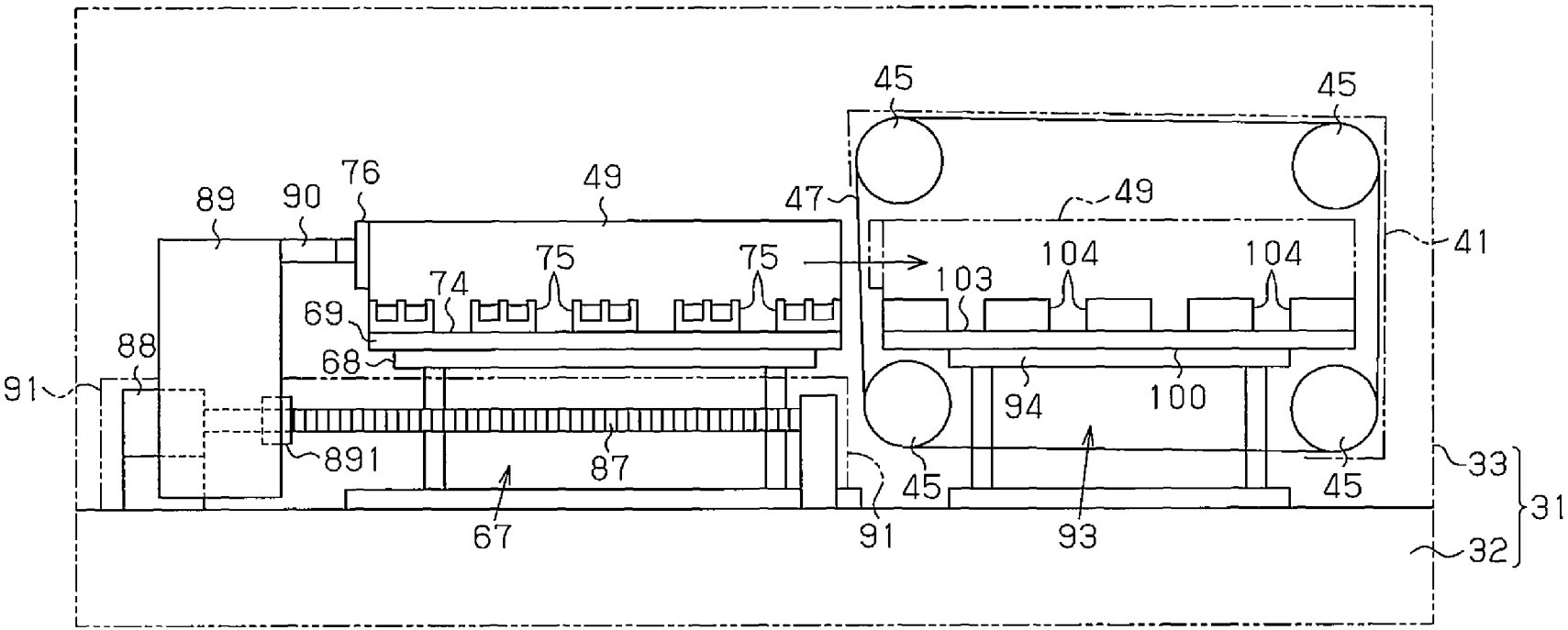
FIG. 6 is a schematic configuration view showing the inner configuration of the wire saw shown in FIG. 1 in an enlarged manner.
Figure 7:
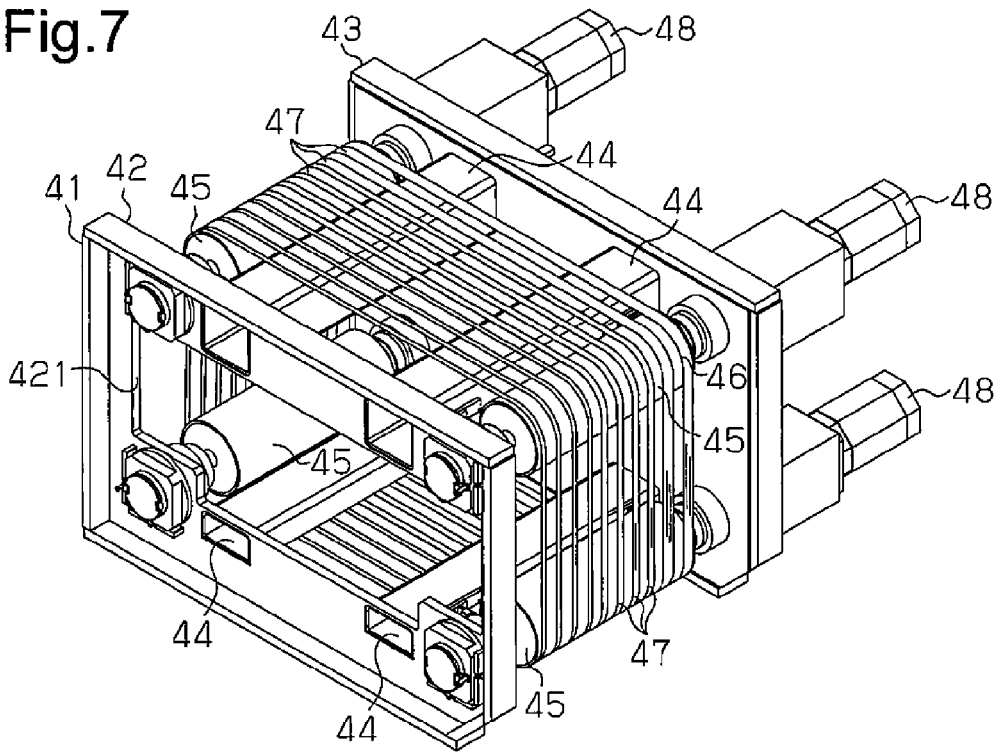
FIG. 7 is a perspective view showing the support configuration for supporting machining rollers in the wire saw shown in FIG. 1 as viewed from a front side.
Figure 8:
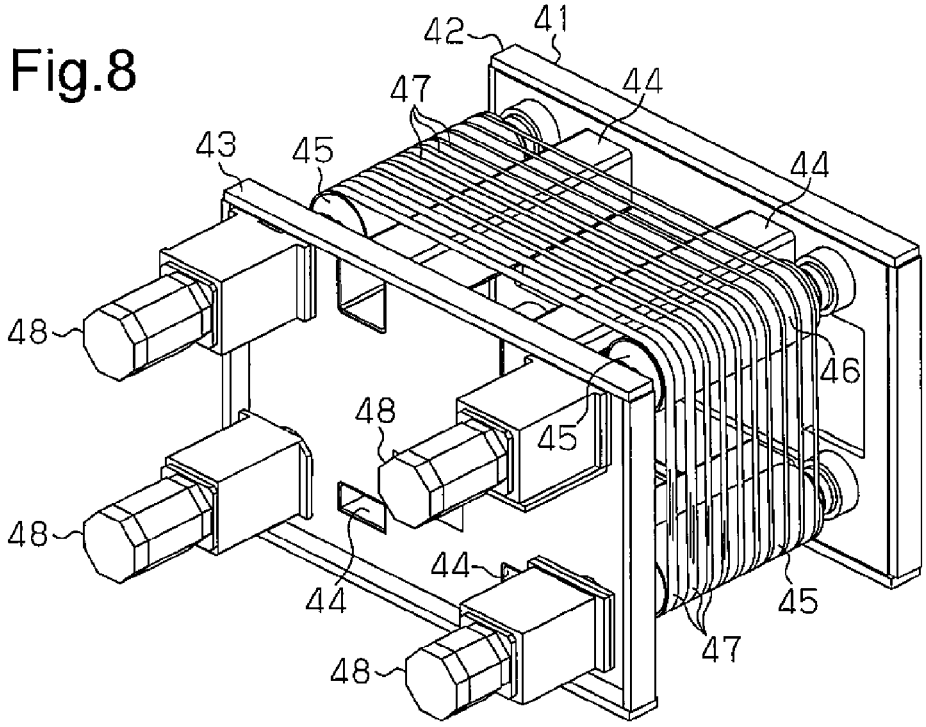
FIG. 8 is a perspective view showing the support configuration for supporting the machining rollers shown in FIG. 7 as viewed from a back side.

As shown in FIGS. 6 to 8, a support bracket 41 is fixed to a right upper surface of the device base 32 of the device frame 31. The support bracket 41 includes a pair of front and rear frames 42, 43 which is formed of an iron plate; and a plurality of bridging members 44 which extend between both frames 42, 43, are formed of an iron-made square pipe, and function as reinforcing members. An opening 421 for conveying the machined workpiece 49 toward a front side is formed in the front frame 42. Four machining rollers 45 are supported between the frames 42, 43 of the support bracket 41 such that these four machining rollers 45 are arranged at vertex points of a rectangular shape. That is, four machining rollers 45 are arranged at an upper position and a lower position on a left side as well as at an upper position and a lower position on a right side parallel to each other along the horizontal direction and in a spaced-apart manner from each other in FIG. 6. Each machining roller 45 is rotatable about an axis thereof. A number of annular grooves 46 is formed on an outer peripheral surface of each machining roller 45. Wires 47 extend between and are wound around the annular grooves 46 formed on the machining roller 45 in a winding state. In FIGS. 3 to 5, the internal structure of the support bracket 41 and the internal structure of the machining roller 45 are omitted.

Figure 9:
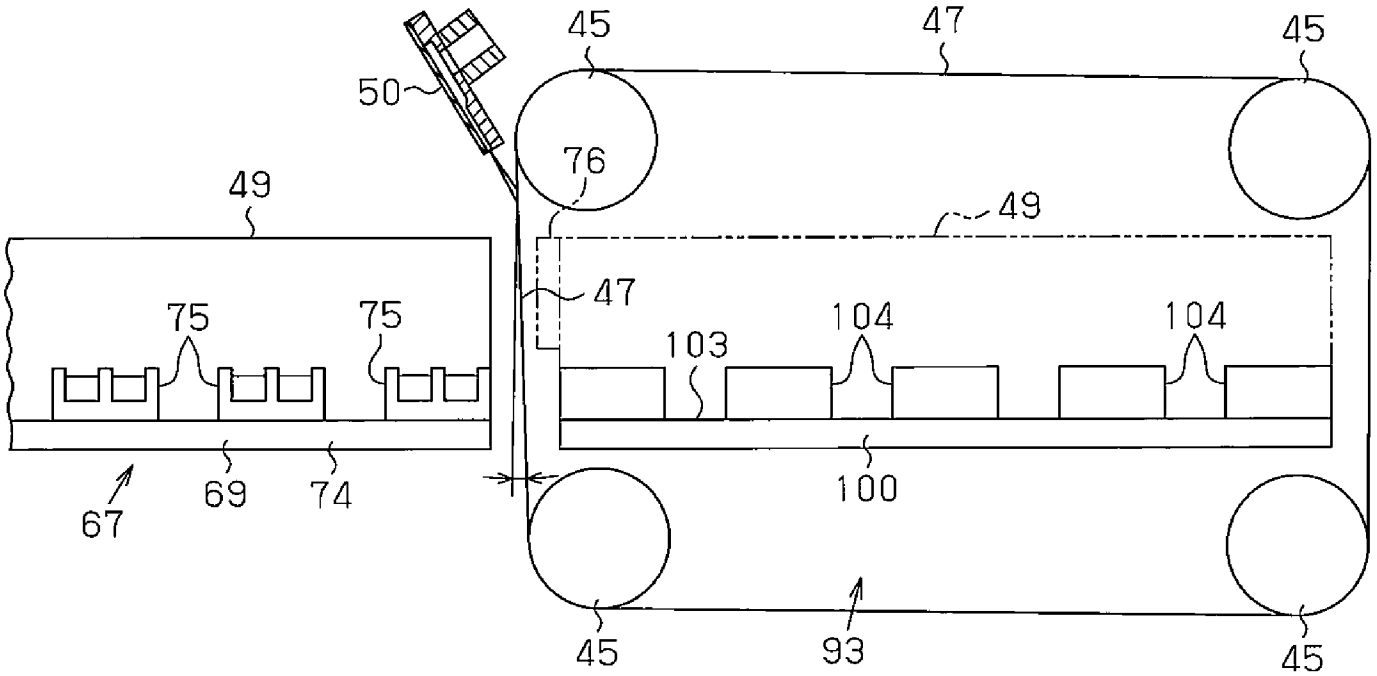
FIG. 9 is a cross-sectional view showing the arrangement configuration of the machining rollers in the wire saw shown in FIG. 1 and also showing a supply nozzle for supplying a machining liquid to a wire extending between the machining rollers.

As shown in FIGS. 7 and 8, four motors 48, which directly and rotationally drive the machining rollers 45, respectively, are supported on a rear surface of the rear frame 43 of the support bracket 41. The machining rollers 45 are rotated in the same direction and at the same speed by these motors 48 so that the wires 47 move around the machining rollers 45 in a circulating manner. In such a state, as shown in FIG. 6, the workpiece 49 is made to move toward a workpiece cutting position along the workpiece conveying direction. That is, the workpiece 49 is conveyed and moved horizontally in the rightward direction toward the wires 47 extending between the machining rollers 45 arranged on left upper and lower sides respectively. Then, the workpiece 49 is cut into slices by the wires 47 from a distal end of the workpiece 49 in the conveying direction. In this case, the respective machining rollers 45 are rotationally driven in synchronism with each other by the plurality of motors 48 respectively and hence, a tension generated in the wires 47 extending between the machining rollers 45 is maintained at an approximately fixed value. As shown in FIG. 9, at the workpiece cutting position, a supply nozzle 50 is located above the workpiece 49. When the workpiece 49 is cut by the wires 47, a machining liquid such as slurry is supplied to the wires 47 by the supply nozzle 50 at the workpiece cutting position from an oblique upper side.

As shown in FIG. 9, of the plurality of machining rollers 45, the machining roller 45, which is arranged on a lower left side, is arranged in a rightwardly displaced manner with respect to the machining roller 45 arranged on a left upper side. That is, the machining roller 45 arranged on a lower side at the workpiece cutting position is arranged on a downstream side in the workpiece conveying direction compared to the machining roller 45 arranged on an upper side. With this configuration, the wires 47 extending between the machining rollers 45 arranged on left upper and lower sides are located in a rightward inclined manner with respect to the vertical direction as the wires 47 extend downward. When the workpiece 49 is cut by the wires 47, the moving direction of the workpiece 49 is inclined with respect to the wires 47 and hence, it is possible to suppress a high tension from suddenly acting upon the wires 47. Further, cutting debris produced at the time of cutting the workpiece 49 by the wires 47 falls down without being caught in the traveling wires 47.

Figure 10:
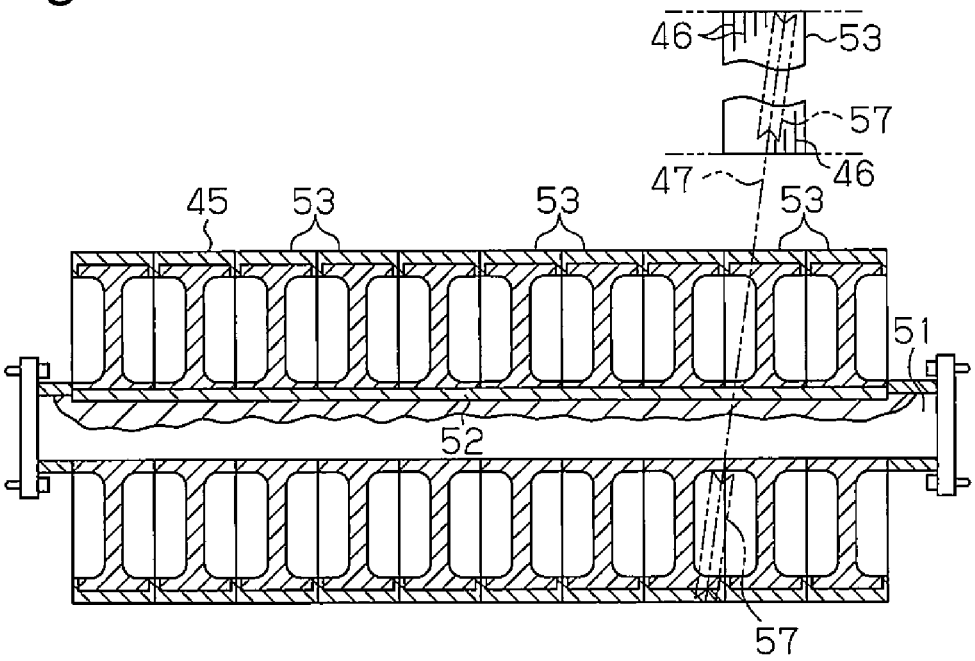
FIG. 10 is a cross-sectional view showing the machining roller in the wire saw shown in FIG. 1 in an enlarged manner.
Figure 11:
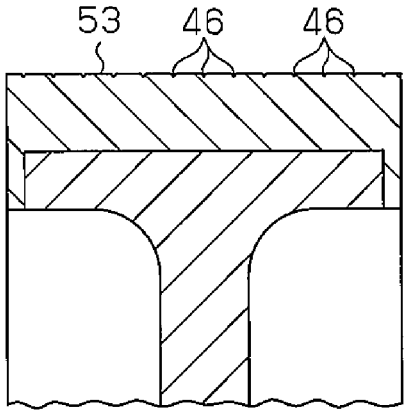
FIG. 11 is a partially cross-sectional view showing one roller piece of the machining roller shown in FIG. 10 in a further enlarged manner.

As shown in FIGS. 10 and 11, each machining roller 45 includes a support shaft 51, which extends in the axial direction of the machining roller 45, and a plurality of disc-like roller pieces 53, which is fitted on the support shaft 51 with a key 52 interposed therebetween. The roller pieces 53 are laminated to each other in a detachable and exchangeable manner along the axial direction of the machining roller 45. The plurality of roller pieces 53 are arranged parallel to each other corresponding to positions and thicknesses of the plurality of workpieces 49. The annular grooves 46 are formed on the outer periphery of the roller piece 53 at a predetermined pitch. The roller piece 53 is exchangeable with a roller piece on which annular grooves 46 are formed with a different width or at a pitch different from that of the roller piece 53 by removing the respective roller pieces 53 on the support shaft 51 corresponding to a position and a thickness of the workpiece 49.

Figure 12:
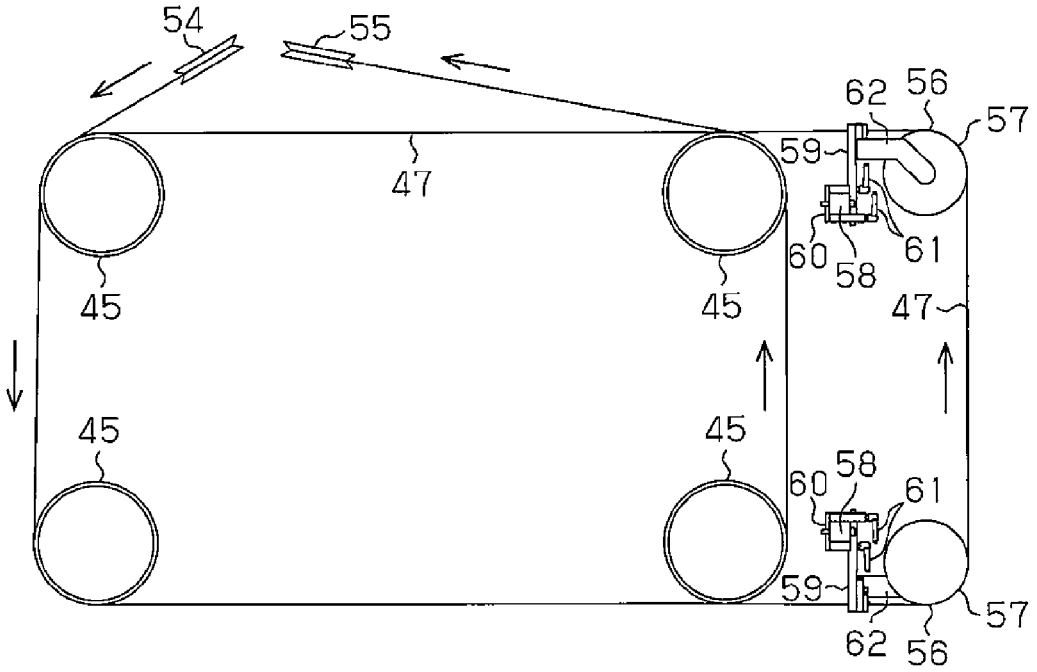
FIG. 12 is a front view showing the guide configuration for guiding the wire with respect to the machining rollers in the wire saw shown in FIG. 1.
Figure 13:
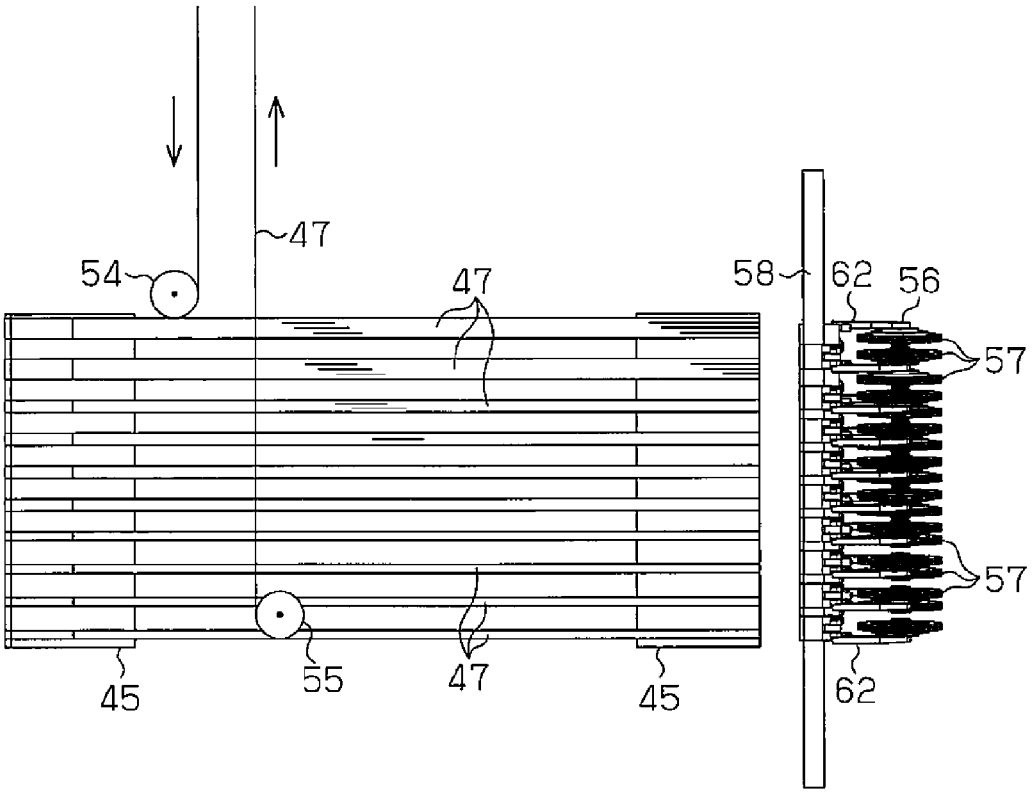
FIG. 13 is a plan view of the guide configuration for guiding the wire shown in FIG. 12.
Figure 14:
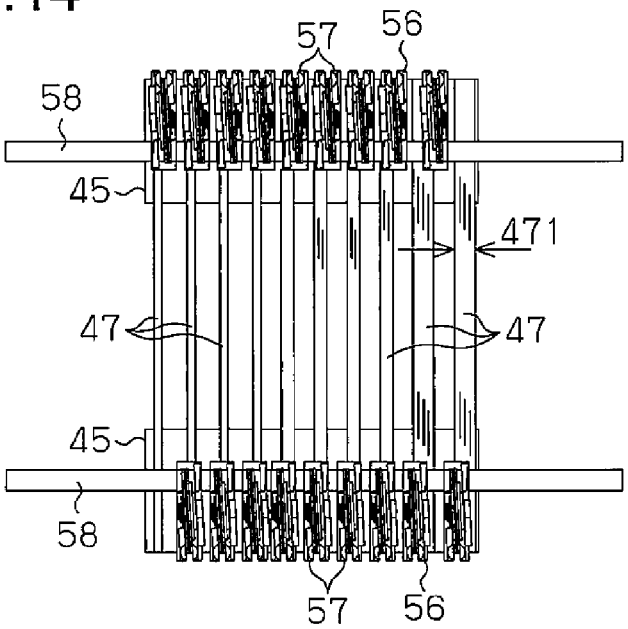
FIG. 14 is a side view of the guide configuration for guiding the wire shown in FIG. 12.

As shown in FIGS. 12 to 14, a first wire guide 54, which is arranged on a wire path between one end portion of the left upper machining roller 45 and a reel not shown in the drawing, is arranged above the machining rollers 45. Further, a second wire guide 55, which is positioned on a wire path between the other end portion of the right upper machining roller 45 and a reel not shown in the drawing, is arranged above the machining rollers 45. In detachably mounting the pair of reels around which both end portions of the wire 47 are wound in the device frame 31, as shown in FIG. 5, the whole rear opening 35 is opened.

Guide roller units 56 are respectively arranged on a right side of the machining rollers 45, which are arranged on right upper and lower sides. As shown in FIGS. 10 and 14, each guide roller unit 56 includes a plurality of guide rollers 57 such that the plurality of guide rollers 57 correspond to the plurality of roller pieces 53 of the machining roller 45 respectively. Each guide roller 57 guides the wire 47 obliquely from the roller piece 53 of the upper machining roller 45 to the roller piece 53 of the lower machining roller 45 which corresponds to the roller piece 53 arranged adjacent to the roller piece 53 of the upper machining roller 45. The number of times that the wires 47 circulate around each roller piece 53 is determined based on the number of annular grooves 46 formed on the roller piece 53. As can be clearly understood from FIG. 14, a winding width 471 of the wires 47 on each roller piece 53 is also changed depending on the number of the annular grooves 46 formed on the roller piece 53.

As shown in FIGS. 12 to 16, the guide roller unit 56 includes a support rod 58, which extends parallel to an axis of the machining roller 45 and is formed of a channel member. The support rod 58 is fixed to the device frame 31. A plurality of support plates 59, which respectively correspond to the plurality of guide rollers 57, is supported on the support rod 58 in a movable manner along the extending direction of the support rod 58 (in the axial direction of the machining roller 45). Each support plate 59 includes an engaging recessed portion 591 on a proximal end portion thereof, and is engaged with the support rod 58 at the engaging recessed portion 591. On an open end portion of the engaging recessed portion 591 of the support plate 59, fixing plates 60 are mounted in a movable manner such that the fixing plates 60 selectively approach and separate from the support rod 58. A pair of operation levers 61 for movably operating the fixing plate 60 is rotationally supported on a side surface of the support plate 59. When both operation levers 61 are operated by rotation in a state where the support plate 59 is moved to a predetermined position on the support rod 58, the fixing plate 60 is moved to a position where the fixing plate 60 pushes the support rod 58 so that the support plate 59 is fixed to the predetermined position on the support rod 58.

Figure 15:
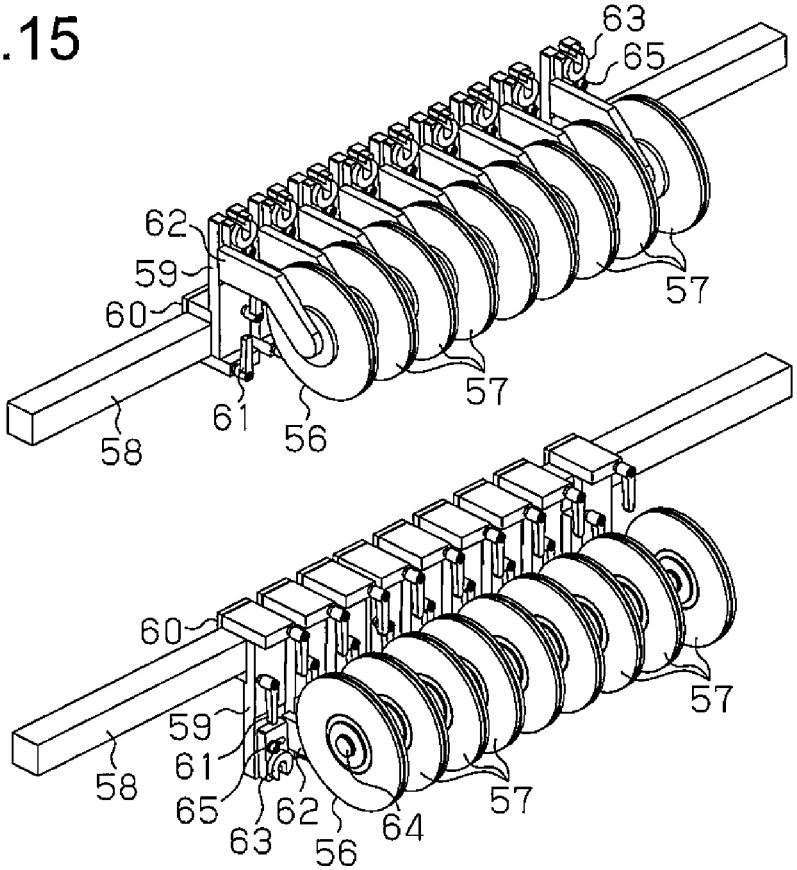
FIG. 15 is a perspective view showing a guide roller unit in the guide configuration for guiding the wire shown in FIG. 12.
Figure 16:
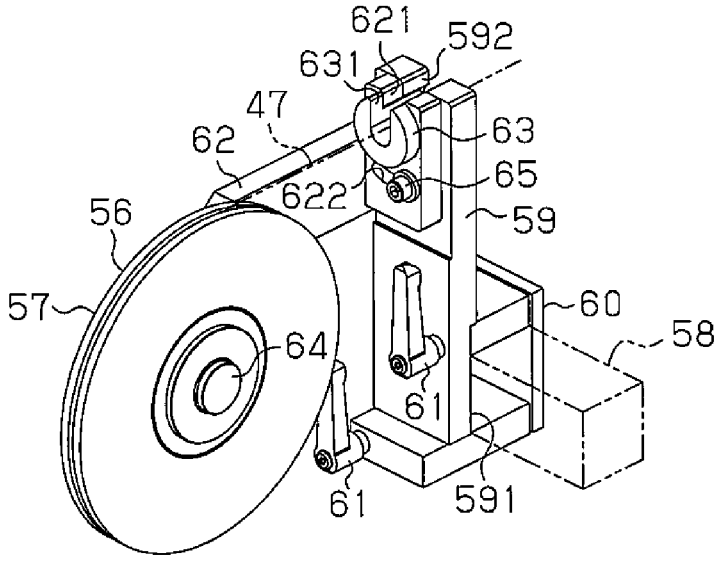
FIG. 16 is a perspective view showing one guide roller in the guide roller unit shown in FIG. 15 in an enlarged manner.

As shown in FIGS. 15 and 16, a guide groove 592 for guiding the wire 47 is formed on a distal end portion of the support plate 59 of the guide roller unit 56. An approximately L-shaped planar support arm 62 is supported on a side surface of the support plate 59 in a rotatable manner about an axis of the guide groove 592 formed on the support plate 59 by way of a shaft support member 63. Guide grooves 621, 631, which are aligned with the guide groove 592 formed on the support plate 59, are formed on a distal end of a proximal portion of the support arm 62 and the shaft support member 63, respectively. Further, the guide roller 57 is rotationally supported on a distal end of a side portion of the support arm 62 by way of a support shaft 64.

As shown in FIGS. 15 and 16, an elongated hole 622 is formed in the proximal portion of the support arm 62 of the guide roller unit 56 such that the elongated hole 622 extends in an arcuate shape about an axis of the guide grooves 592, 621, 631. A fixing screw 65 is threaded to the support plate 59 through the elongated hole 622 formed in the support arm 62. When the support arm 62 is rotated about the axis of the guide grooves 592, 621, 631 in a state where the fixing screw 65 is loosened, an inclination angle of the guide roller 57 is adjusted corresponding to a winding width of the wires 47 on the roller piece 53. A winding width of the wires 47 on the roller piece 53 corresponds to a plate thickness of the workpiece 49. By fastening the fixing screw 65 in such a state, the support arm 62 is fixed to the support plate 59 thus holding the guide roller 57 at an adjusted inclination angle. With this configuration, an inclination angle of the guide rollers 57 can be adjusted corresponding to a size of an arrangement pitch of the roller pieces 53.

Figure 17:
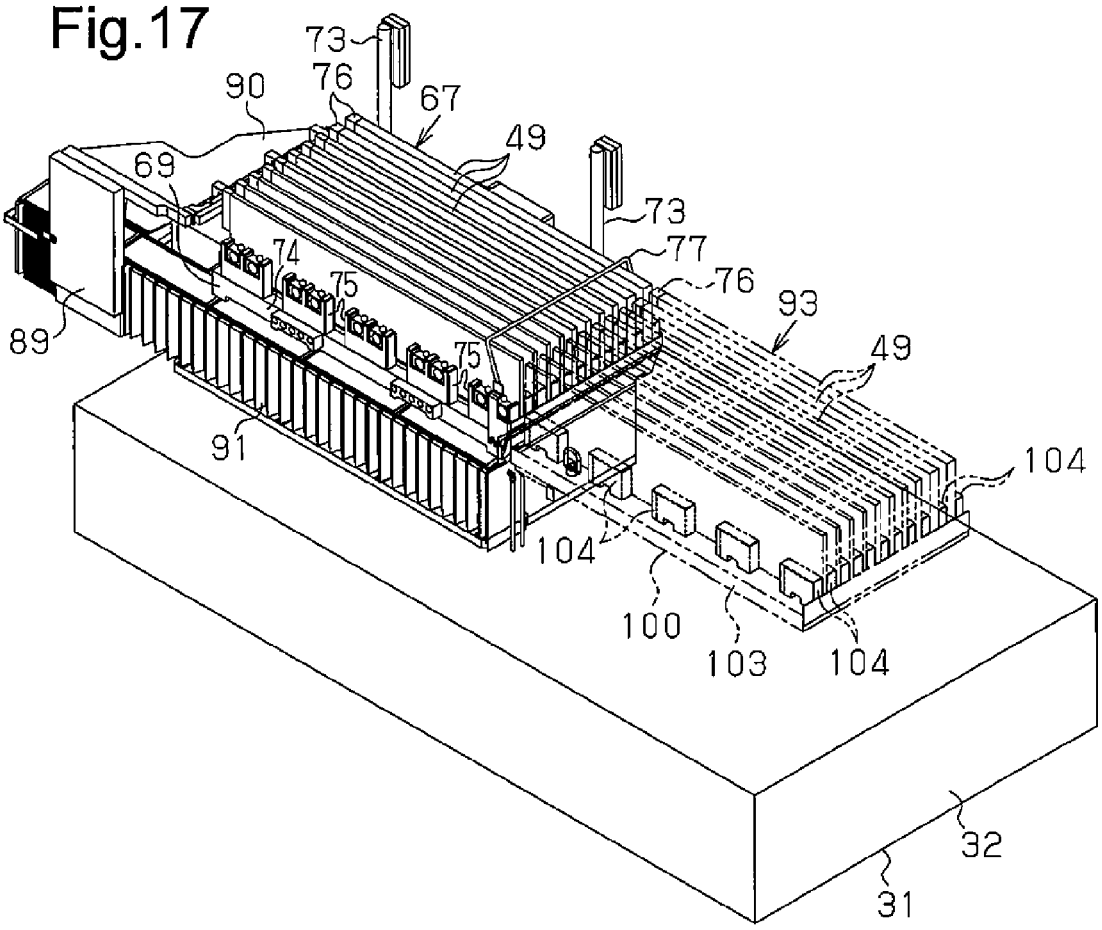
FIG. 17 is a perspective view showing a workpiece guide part and a workpiece receiving part in the internal configuration of the wire saw shown in FIG. 6.
Figure 18:
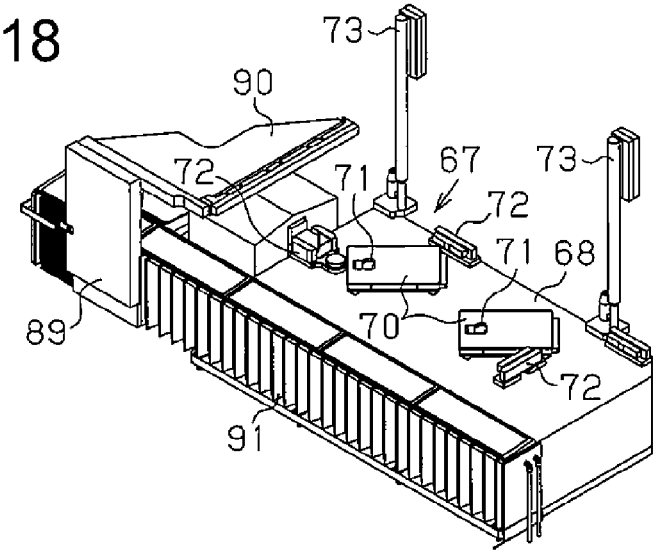
FIG. 18 is a perspective view showing the support and drive configuration for supporting and driving the workpiece guide part shown in FIG. 17.

As shown in FIGS. 6, 17 and 18, a supply pallet 67 which functions as a workpiece guide part for moving the plate-like workpiece 49 along the workpiece conveying direction is arranged on a left side of the upper surface of the device base 32 of the device frame 31. With this configuration, unlike the conventional configuration where a workpiece is supplied to wires between machining rollers from above, it is also possible to convey the elongated plate-like workpiece 49 easily in the transverse direction toward the workpiece cutting position without requiring the device frame 31 to ensure a large size in height.

A support table 68 is fixed to the device base 32. A pair of support bases 70 for detachably supporting the supply pallet 67 which mounts the plurality of plate-like workpieces 49 thereon is arranged on an upper surface of the support table 68. On each support base 70, an engaging projection 71, which is engageable with an engaging hole formed in a bottom surface of the supply pallet 67 and is not shown in the drawing, is formed. On the upper surface of the support table 68, a plurality of positioning members 72 is arranged for positioning the supply pallet 67 to a predetermined position corresponding to the wires 47 extending between the machining rollers 45. On an upper surface of a rear portion of the support table 68, a pair of guide rods 73 for guiding the conveying-in operation of the supply pallet 67 on which the workpieces 49 are arranged onto the support bases 70 are formed in a projecting manner.

When the non-machined workpiece 49 is conveyed into the device frame 31, as shown in FIG. 3, three front doors 36 on a left side are stored in the front door storing portion 38 so that the left portion of the front opening 34 is opened. In such a state, the supply pallet 67 on which the plurality of plate-like workpieces 49 are arranged is suspended by a crane and is conveyed into the device frame 31 through the left opening portion of the front opening 34. Then, the supply pallet 67 is placed on the support bases 70 while being guided by the guide rods 73 and is positioned at a predetermined position by the positioning members 72 and, at the same time, is held on the support bases 70 in a non-movable manner due to the engagement with the engaging projections 71.

As shown in FIGS. 17 and 19 to 21, the supply pallet 67 includes a guide base 74. On an upper surface of the guide base 74, a plurality of bottom portion guide surfaces 741, which are formed of projecting ridges, and a plurality of recessed-groove-shaped arrangement portions 742 are formed alternately. The bottom portion guide surfaces 741 are provided to guide the plurality of plate-like workpieces 49 to slide rightward in a state where the workpieces 49 are arranged parallel to each other by supporting bottom portions of the workpieces 49. On each arrangement portion 742, workpiece guide members 75 are arranged.

On a rear end of each workpiece 49 in the workpiece conveying direction, that is, on an upper portion of a left end of each workpiece 49, a small, piece-like, trimmable abandoning member 76, which is made of a synthetic resin is mounted. The abandoning member 76 is adhered to the portion using an adhesive having a low melting point before the workpiece 49 is arranged on the guide base 74.

On an upper portion of a right end of the guide base 74, before the supply pallet 67 is conveyed into the device frame 31, a workpiece restricting member 77, which functions as a slip-down prevention member, is mounted in a detachable manner due to engagement between engaging recessed portions 771 formed on both side lower ends of the workpiece restricting member 77 and engaging pins 78 formed on the guide base 74. The workpiece restricting member 77 includes: a restricting part 772 for restricting the slip-down of the workpieces 49 on the support pallet 67 in the rightward direction at the time of conveying-in the supply pallet 67 in the device frame 31 using the crane; and a handle 773 for mounting or dismounting the workpiece restricting member 77 on and from the supply pallet 67.

Figure 19:
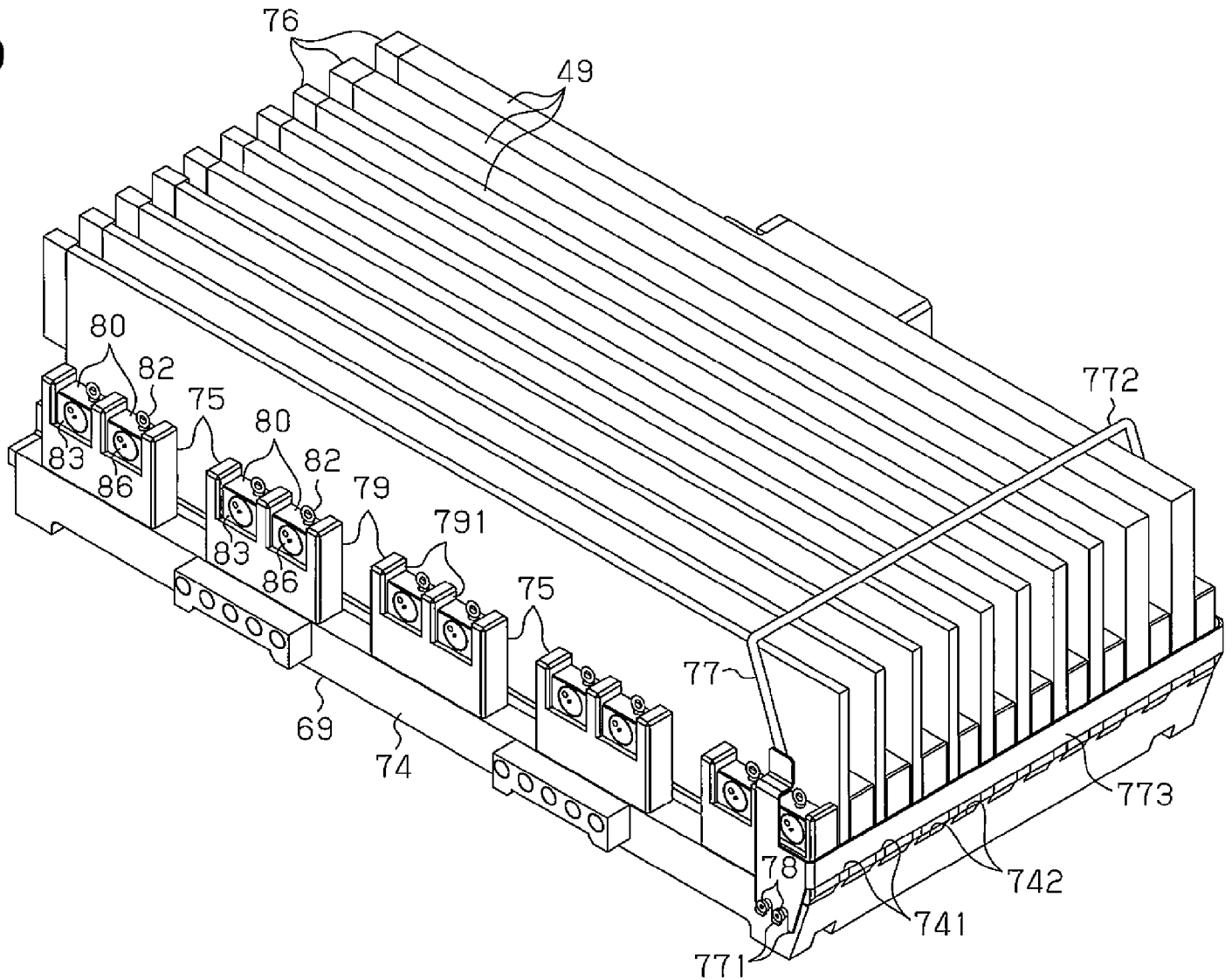
FIG. 19 is a perspective view showing the workpiece guide part shown in FIG. 17 and a workpiece supported by the workpiece guide part in an enlarged manner.
Figure 20:
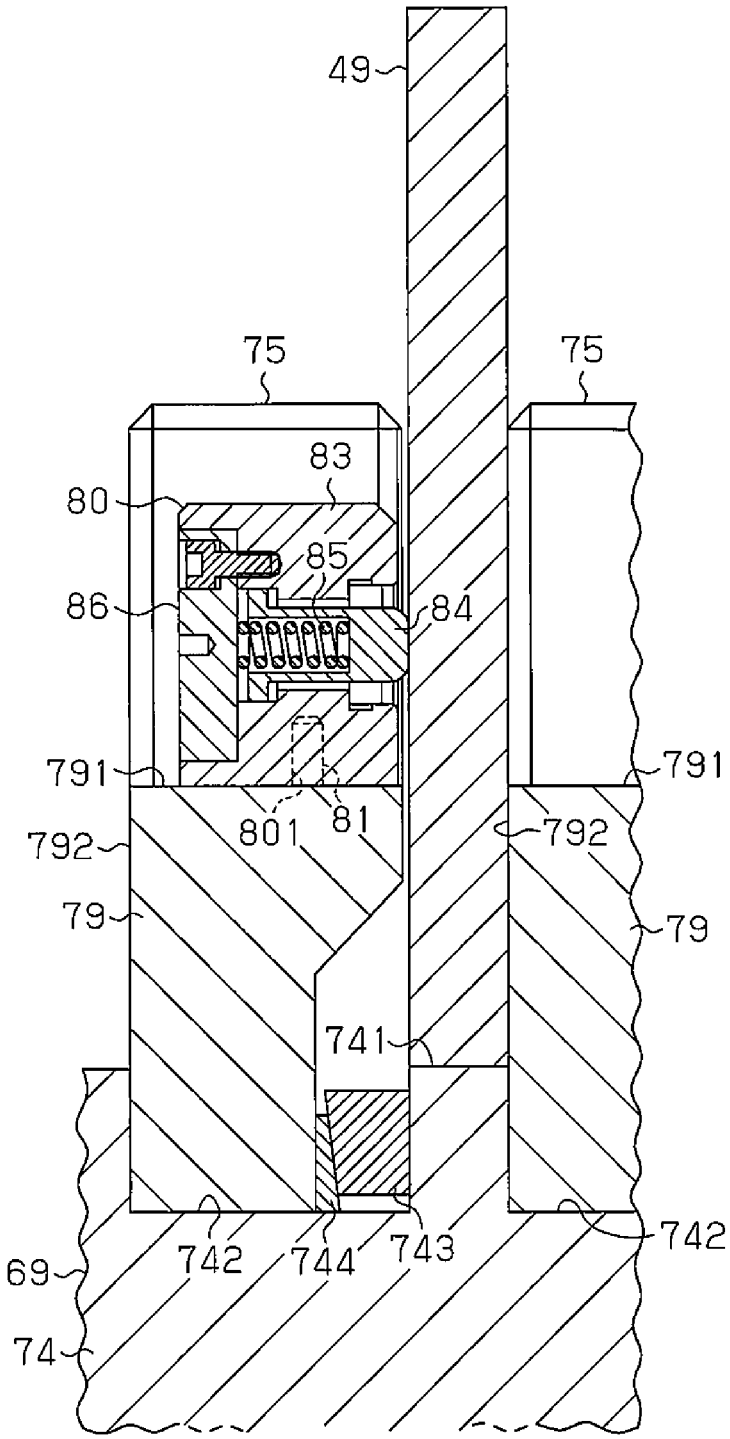
FIG. 20 is a partially enlarged cross-sectional view showing the pushing configuration for pushing a workpiece in the workpiece guide part shown in FIG. 19.
Figure 21:
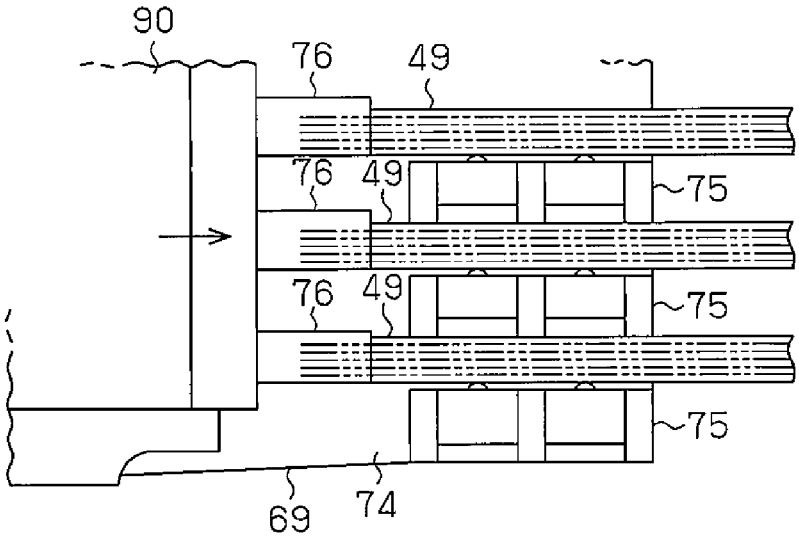
FIG. 21 is a partially enlarged plan view showing a state where a workpiece has been cut by the wire in the wire saw shown in FIG. 1.
Figure 22:
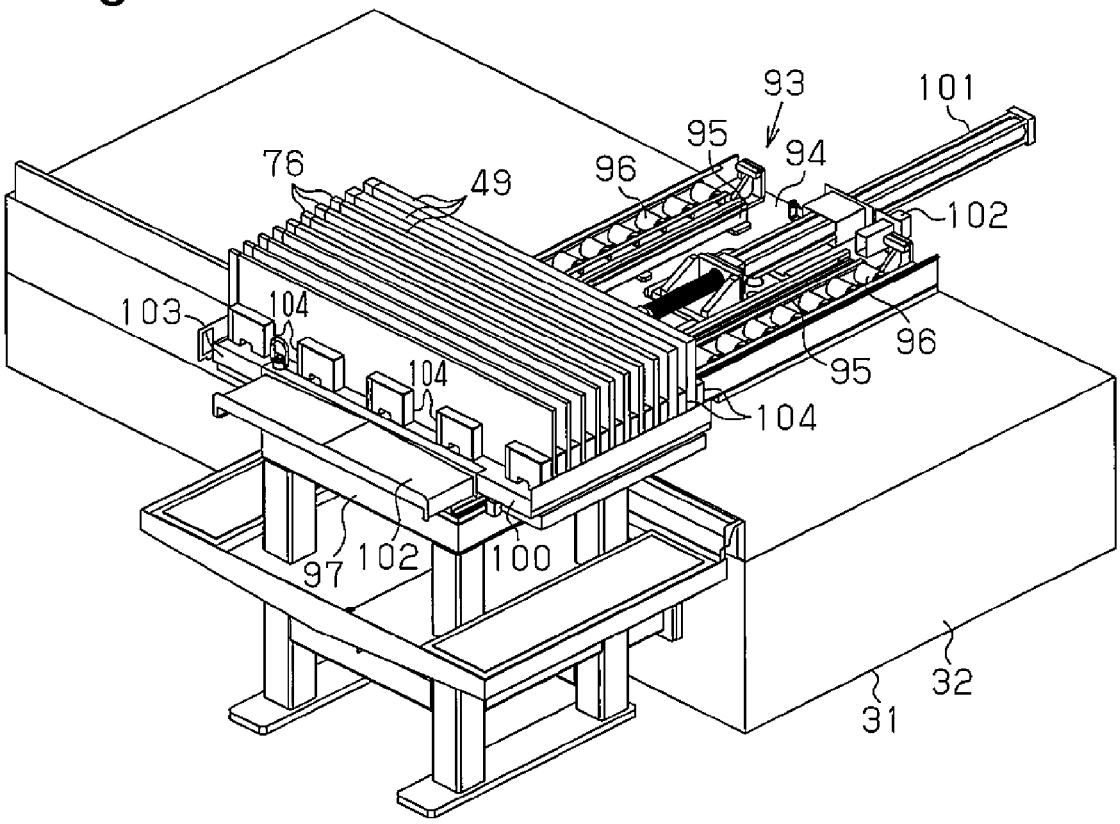
FIG. 22 is a perspective view showing the conveying-out drive configuration of the workpiece receiving part shown in FIG. 17.
Figure 23:
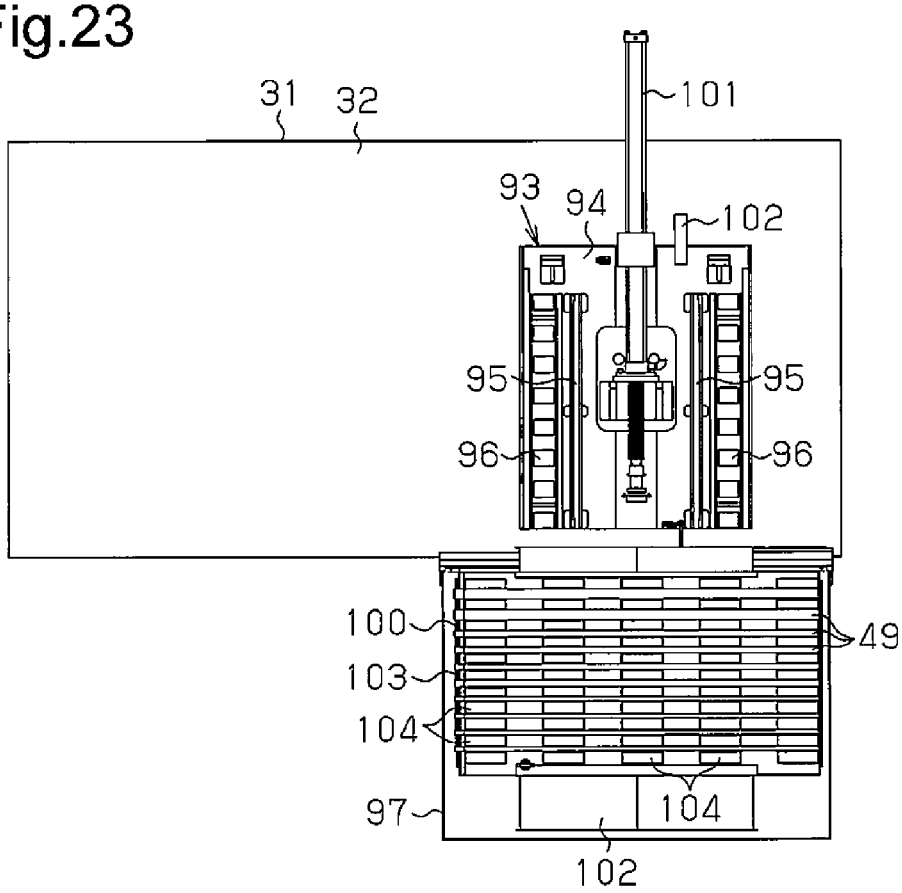
FIG. 23 is a plan view of the conveying-out drive configuration shown in FIG. 22.
Figure 24:
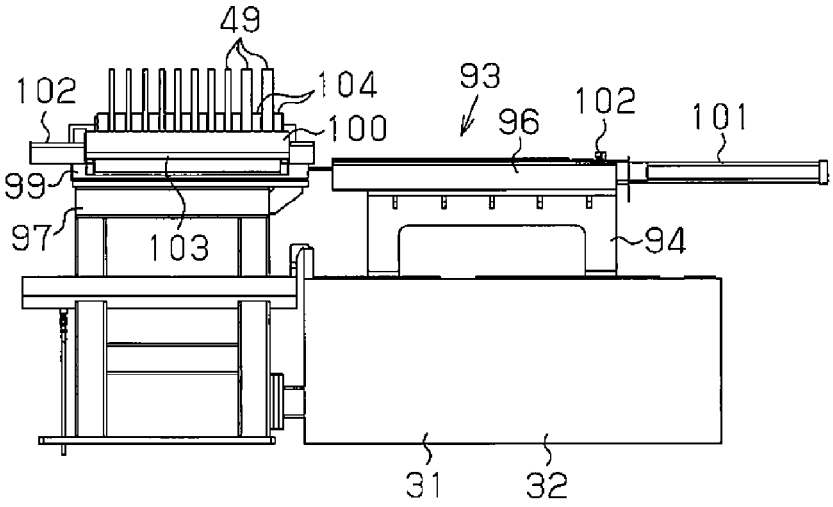
FIG. 24 is a side view of the conveying-out drive configuration shown in FIG. 22.

As shown in FIGS. 19 and 20, the workpiece guide members 75 of the supply pallet 67 respectively include guide blocks 79, which are arranged on the arrangement portion 742 of the guide base 74 at intervals. On one side surface of the guide block 79, a side portion guide surface 792 for guiding a first side surface of the workpiece 49 on the bottom portion guide surface 741 is formed. The guide block 79 is fixed in the arrangement portion 742 by a wedging action of two wedge-shaped fixing members 743, 744. Accordingly, by removing the fixing members 743, 744, the guide block 79 can be exchanged. For the exchange of the guide block 79, plural kinds of guide blocks having different thicknesses are prepared. As shown in FIG. 19, the guide blocks 79 on a frontmost portion are fixed to the guide base 74 in a non-movable manner.

A pair of recessed portions 791 is formed on an upper surface of the guide block 79. In each recessed portion 791 of the guide block 79, a pusher 80 is mounted in a detachable manner due to an engagement between an engaging hole 801 formed in a bottom surface of the pusher 80 and an engaging pin 81 formed on an inner bottom surface of the recessed portion 791 in a projecting manner. On an upper surface of the pusher 80, a loop-shaped handle 82 for mounting or dismounting the pusher 80 in and from the recessed portion 791 of the guide block 79 is mounted in a projecting manner.

Each pusher 80 includes a support block 83 in which a pushing pin 84, which is movable in the direction orthogonal to the side surface of the workpiece 49, is located. Each pusher 80 includes a spring 85, which biases the pushing pin 84 to push the pushing pin 84 against the side surface of the workpiece 49, and a holding plate 86 for holding the pushing pin 84 and the spring 85 in the support block 83. The pushing pin 84 of the pusher 80 pushes a second side surface of the workpiece 49 due to a biasing force of the spring 85 so that the workpiece 49 is held between the pushing pin 84 and a side portion guide surface 792 of a neighboring guide block 79 in a guidable manner. When a plate thickness of the workpiece 49 is changed, the guide block 79 is exchanged with a guide block having the different thickness. In this case, by holding the handle 82, the pusher 80 can be remounted on a newly used guide block 79.

As shown in FIGS. 6, 17, 18 and 21, on the device base 32 of the device frame 31, a ball screw 87 extends along the moving direction (workpiece conveying direction) of the workpiece 49, and the ball screw 87 is supported in a rotatable manner about an axis thereof. A motor 88 for rotating the ball screw 87 is located on the device base 32. A movable member 89 is engaged by threads with the ball screw 87 by way of a nut 891 in a movable manner relative to the ball screw 87 along the axial direction of the ball screw 87. A push-out body 90, which can be bonded to the abandoning member 76 adhered to a left end of the workpiece 49, is mounted on an upper end of the movable member 89. A flexible cover 91 for covering the periphery of the ball screw 87 and the periphery of the motor 88 is mounted on the device base 32.

When the ball screw 87 is rotated by the motor 88, the movable member 89 is moved rightward in FIG. 6, and the plurality of workpieces 49 on the supply pallet 67 are pushed out in the workpiece conveying direction by means of the push-out body 90. With this operation, the respective workpieces 49 are conveyed toward the wires 47 extending between the machining rollers 45 along the bottom portion guide surface 741 on the guide base 74 in a state where the respective workpieces 49 are arranged parallel to each other in an upright state, and the respective workpieces 49 are cut into slices by the wires 47 from distal ends thereof in the workpiece conveying direction. In this case, as shown in a chain line in FIG. 21, the workpiece 49 is cut into slices over the whole length thereof, and the abandoning member 76 adhered to the left end of the workpiece 49 is also cut.

As shown in FIGS. 1, 6, 17, and 22 to 24, on a right side of the upper surface of the device base 32 of the device frame 31 and downstream of the wires 47 in the workpiece conveying direction, a workpiece receiving position is set. At the workpiece receiving position, a workpiece receiving part 93 for receiving the cut workpieces 49 is located. That is, the workpiece receiving part 93 is located downstream of the workpiece cutting position in the workpiece conveying direction. The workpiece receiving part 93 and the supply pallet 67 are arranged parallel to each other with the wires 47 extending between two machining rollers 45 arranged above and below the workpiece cutting position sandwiched therebetween. The workpiece receiving part 93 includes a support table 94, which is fixed to the device base 32. On an upper surface of the support table 94, a pair of guide rails 95 and a pair of roller conveyers 96 are mounted such that the guide rails 95 and the roller conveyers 96 extend parallel to each other along the longitudinal direction orthogonal to the workpiece conveying direction. A conveying-out table 97 is arranged outside the device frame 31 and in front of the support table 94. On an upper surface of the conveying-out table 97, a pair of guide rails 98 and a pair of roller conveyers 99 are mounted such that the guide rails 98 and the roller conveyers 99 are aligned with the guide rails 95 and the roller conveyers 96 mounted on the support table 94.

A receiving pallet 100 is supported on both roller conveyers 96, 99 in a longitudinally movable manner along both guide rails 95, 98. The receiving pallet 100 holds the workpieces 49, which are cut into slices while keeping the workpieces 49 at an upright state. The upright state is a conveying posture. The receiving pallet 100 is movable between an area inside a circulating region where the wires 47 circulate and an area in front of and outside the circulating region. A cylinder 101, which functions as a conveying-out member for moving the receiving pallet 100 in the longitudinal direction, is located on the support table 94. A stopper 102 for restricting a moving end position of the receiving pallet 100 is located on a rear end of the upper surface of the support table 94 and a front end of the upper surface of the conveying-out table 97 respectively. Before the workpieces 49 are cut, the receiving pallet 100 is moved and located at the workpiece receiving position inside the wire circulating region on the support table 94 by the cylinder 101. In such a state, the receiving pallet 100 receives the cut workpieces 49 while keeping the workpieces 49 in an upright state, and the cut workpieces 49 are detained inside the circulating region of the wires 47. Thereafter, the receiving pallet 100 is moved frontward by the cylinder 101, and the cut workpieces 49 are moved toward the outside from the inside of the circulating region of the wire 47 along the axial direction of the machining roller 45, and are arranged on the conveying-out table 97.

As shown in FIGS. 6, 17, and 22 to 24, the receiving pallet 100 of the workpiece receiving part 93 includes a holding plate 103 having a flat plate shape. A plurality of small-piece-like holding members 104 for holding the workpieces 49 in parallel to each other while keeping the workpieces 49 in an upright state are mounted on an upper surface of the holding plate 103 in an upright state. The holding members 104 are arranged in a spaced-apart manner in the longitudinal direction by a distance corresponding to a plate thickness of the workpiece 49 and are also arranged in a spaced-apart manner in the lateral direction. The cut workpieces 49 are held on the holding plate 103 while being kept in an upright state by the respective holding members 104.

Next, an operation of the wire saw having the above-mentioned configuration is described.

When machining the workpieces by using the wire saw, a plurality of plate-like workpieces 49 are mounted on the supply pallet 67 in a state where the workpieces 49 are arranged parallel to each other in an upright state, and the positions of the workpieces 49 are restricted by the workpiece restricting member 77. As shown in FIG. 3, the left portion of the front opening 34 of the device frame 31 is opened, and the supply pallet 67 on which the workpieces 49 are mounted is suspended by a crane not shown in the drawing, and is conveyed into the device frame 31 from the left opening portion of the front opening 34. After the supply pallet 67 is conveyed into the device frame 31, the workpiece restricting member 77 is removed from the supply pallet 67. Then, the supply pallet 67 is placed on the support base 70 of the support table 68, and is positioned by the positioning members 72. The supply pallet 67 is held in such a positioned state due to the engagement with the engaging projections 71 in a non-movable manner. Each workpiece 49 is placed on the bottom portion guide surface 741 of the supply pallet 67 and is pushed to the guide surface 792 of the neighboring guide block by the pushing pin 84 of the guide block 79. Although the plurality of workpieces 49 can be placed on the bottom portion guide surface 741 in a laminated manner, in this case, a width of the bottom portion guide surface 741 becomes the maximum lamination thickness.

Then, as shown in FIG. 1, after the front opening 34 of the device frame 31 is closed, the respective machining rollers 45 are synchronously rotated in the same direction by the plurality of motors 48 shown in FIGS. 7 and 8, and the wires 47 are circulated around the machining rollers 45. Further, in the supply pallet 67 shown in FIG. 6, the ball screw 87 is rotated by the motor 88 and hence, the movable member 89 is moved to a right side in the drawing, and the plurality of plate-like workpieces 49 on the supply pallet 67 are pushed in the workpiece conveying direction by means of the push-out body 90. With this configuration, the respective workpieces 49 are moved in the workpiece conveying direction along the bottom portion guide surfaces 741 and the side portion guide surfaces 792 on the guide base 74 of the supply pallet 67 in a state where the workpieces 49 are arranged parallel to each other. The workpieces 49 are moved toward the wires 47 to which a tension is applied in the vertical direction between the machining rollers 45 arranged on the upper and lower sides at the workpiece cutting position, and the workpieces 49 are cut into slices by the wires 47 from the distal ends thereof in the workpiece conveying direction. Prior to such a cutting, the machining roller 45 is formed by assembling the desired number of roller pieces 53 having desired widths and a desired pitch of annular grooves 46 in accordance with the various conditions such as a thickness of the workpiece 49, the number of workpieces 49, a thickness of the workpiece 49 after cutting, and an arrangement interval of the workpieces 49 on the supply pallet 67.

In this manner, the workpieces 49 cut by the wires 47 are held onto the receiving pallet 100 of the workpiece receiving part 93 shown in FIGS. 6 and 22 to 24 while being kept in an upright state, which is a conveying posture. Then, the cut workpieces 49 are detained inside the circulating region of the wires 47 around the machining rollers 45 in such a state. Thereafter, as shown in FIG. 4, the right portion of the front opening 34 of the device frame 31 is opened. In such a state, the receiving pallet 100 is moved frontward by the cylinder 101, the cut workpieces 49 are moved toward the area outside the circulating region of the wires 47 from the area inside the circulating region of the wires 47 along the axial direction of the machining roller 45, and are conveyed out on the conveying-out table 97. Then, the cut workpieces 49 are conveyed to post steps. In the post steps, an adhesive for adhering the abandoning member 76 is dissolved by hot water or the like and thereby the abandoning member 76 is removed from the workpiece 49.

As has been described above, according to this embodiment, the following advantageous effects can be acquired.

(1) The wire saw includes the supply pallet 67, which guides the workpieces 49 to convey the workpieces 49 in an upright state toward the wires 47 extending between the machining rollers 45 along the workpiece conveying direction. The receiving pallet 100 for receiving the cut workpieces 49 while keeping the workpiece 49 in an upright state is located at the workpiece receiving position downstream of the workpiece cutting position in the workpiece conveying direction.

Accordingly, the workpieces 49 are conveyed in an upright state toward the wires 47 extending between the machining rollers 45 by the supply pallet 67, and the workpieces 49 are cut by the wires 47 from the distal end thereof in the workpiece conveying direction. The cut workpieces 49 are received by the receiving pallet 100 at the workpiece receiving position downstream of the wires 47 in the workpiece conveying direction while being kept in an upright state. Accordingly, the workpieces 49 can be conveyed toward the wires 47 extending between the machining rollers 45 without fixing the workpieces 49 to the conveying device thus making the fixing operation of the workpieces 49 to the movable body of the conveying device unnecessary. Further, it is unnecessary to move the cut workpieces 49 such that the cut workpieces 49 return in the direction opposite to the machining conveying direction and hence, it is possible to prevent the cut workpieces 49 from being damaged due to the contact with the wires 47 or from being bent.

(2) With the use of four machining rollers 45 arranged at vertex positions of the rectangular shape, a height of the machining part on the device base 32 can be lowered thus lowering a height of the wire saw as a whole.

(3) Due to the provision of four motors 48, which directly and rotationally drive four machining rollers 45 respectively, a tension applied to the whole wires 47 extending between the machining rollers 45 can be made uniform. Accordingly, machining accuracy of the wire saw can be enhanced, and a possibility that the wire 47 will be broken can be lowered.

(4) The wire saw of this embodiment includes the pair of frames 42, 43, which face each other, the machining rollers 45 are supported between the frames 42, 43, and the reinforcing bridging members 44, which extend parallel to the axis of the machining rollers 45, extend between the frames 42, 43 in the vicinity of the machining rollers 45 respectively. With this configuration, the rigidity of the support of the machining rollers 45 can be enhanced thus enhancing the machining accuracy.

(5) The machining roller 45 on a lower side at the workpiece cutting position (machining roller at a left upper side in FIG. 6) is arranged downstream of the upper machining roller 45 (the machining roller at a left lower side in FIG. 6) in the workpiece conveying direction. With this arrangement, the wires 47 extending between the pair of machining rollers 45 at the workpiece cutting position are inclined with respect to the vertical line such that the wires 47 becomes more away from the workpieces 49 as the wires 47 extend downward. Accordingly, a cutting load by the workpieces 49 is obliquely applied to the wire 47 and hence, a possibility that the wires 47 will be broken can be reduced. Further, cutting debris produced by the cutting of workpieces falls down to be separated from the wires 47 and hence, such an arrangement is effective to enhance machining efficiency and machining accuracy.

(6) The machining roller 45 is constituted of the plurality of roller pieces 53, which are laminated to each other in the axial direction of the machining roller 45 in a detachable manner. Accordingly, one roller piece 53 can be exchanged with another roller piece 53 having a different width or another roller piece 53 having the different number of annular grooves 46 and hence, the wire saw of this embodiment can cope with a change in thickness of the workpiece 49, a change in the number of laminated workpieces 49 and the like. When any one of the roller pieces 53 is damaged, it is sufficient to exchange only the damaged roller piece 53 and hence, it is unnecessary to exchange the whole machining roller 45.

(7) The wire saw of this embodiment includes the guide rollers 57 each of which guides the wires 47 from the roller piece 53 of one machining roller 45 of the plurality of machining rollers 45 to the roller piece 53 of another machining roller 45, which corresponds to the roller piece 53 arranged adjacent to the roller piece 53 of the one machining roller 45, and these guide rollers 57 are movable along the axial direction of the machining roller 45. Accordingly, it is possible to set a traveling path of the wire corresponding to a width of the roller piece 53 or the number of roller pieces 53 to be used at the position where the machining roller 45 is located.

(8) An inclination angle of an axis of rotation of the guide roller 57 with respect to the axial direction of the machining roller 45 can be adjusted. With this configuration, a traveling path of the wire can be set arbitrarily. Accordingly, it is possible to prevent abnormal wear of the machining roller 45 or the guide roller 57.

(9) The workpiece guide part, which guides a non-machined workpiece, is constituted of the supply pallet 67, which is detachably mounted on the device base 32. The workpiece receiving part, which receives the machined workpieces, is constituted of the receiving pallet 100, which can be advanced into or retracted from the wire saw by the roller conveyer 96 and is detachably mounted on the roller conveyer 96. With this configuration, the workpieces 49 can be placed on the supply pallet 67 outside the wire saw and the supply pallet 67 can be conveyed into the wire saw. The machined workpieces 49 can be conveyed out of the wire saw together with the receiving pallet 100. Accordingly, the conveying-in of the workpieces 49 into the wire saw and the conveying-out of the workpieces 49 from the wire saw can be easily performed without damaging the workpieces 49.

(10) The supply pallet 67 includes the rail-like bottom portion guide surfaces 741 for guiding the workpieces 49 in a slidable manner. Accordingly, it is possible to make the workpieces 49 slide accurately in the conveying direction along the bottom portion guide surfaces 741 of the supply pallet 67 so that the workpieces 49 can be accurately cut into slices having a uniform thickness.

(11) By exchanging the guide block 79 of the above-mentioned supply pallet 67 with a guide block having a thickness different from the thickness of the guide block 79, it is possible to adjust the width of a workpiece guiding space. Accordingly, the wire saw of this embodiment can easily cope with a change in thickness of the conveyed workpiece 49 or a change in the number of laminated workpieces 49 and hence, the wire saw of this embodiment can cope with various machining modes such as a change in kind of the workpiece 49 or a change in the number of workpieces 49 to be subjected to cutting machining.

(12) The workpiece receiving part 93 includes the receiving pallet 100 for keeping the workpiece 49 in an upright state. Accordingly, the workpiece 49, which is cut by the wire 47, can be directly conveyed to the workpiece receiving part 93 from the workpiece cutting position and hence, it is possible to prevent the cut workpiece 49 from being damaged.

(13) The cylinder 101 is provided and functions as a conveying-out member for moving the receiving pallet 100 from the workpiece receiving position to the outside position along the axial direction of the machining roller 45. With this configuration, after cutting the workpieces 49, the workpiece receiving part 93 which supports the workpieces 49 can be moved to the outside position from the workpiece receiving position along the axial direction of the machining roller 45. Accordingly, the cut workpieces 49 can be conveyed to the area outside the circulating region of the wires 47 from the area inside the circulating region of the wires 47 without causing the interference between workpieces 49 and the wires 47 extending between the machining rollers 45 so that the cut workpieces 49 can be easily conveyed to the next step.

(14) The supply pallet 67 and the receiving pallet 100 are arranged on the upstream side and the downstream side of the workpiece cutting position respectively in the workpiece conveying direction. With this configuration, the workpieces 49 can be smoothly conveyed to the receiving pallet 100 from the supply pallet 67 through the workpiece cutting position and, at the same time, the position of the machining region in the wire saw can be lowered.

(15) The workpiece restricting member 77, which restricts the positions of the distal ends of the workpieces 49 in the workpiece conveying direction, is detachably mounted on the supply pallet 67. With this configuration, for example, when the supply pallet 67 is suspended by a crane, it is possible to prevent the slip-down of the workpieces 49 from the pallet 67. It is also possible to determine a conveying start position of the workpieces 49.

(16) The workpieces 49 on the supply pallet 67 are pushed along the workpiece conveying direction by the push-out device such as the push-out body 90 from the rear ends thereof in the workpiece conveying direction so that workpieces 49 are conveyed to the wires 47. Accordingly, all workpieces 49 can be pushed out simultaneously thus acquiring a high operation efficiency.

(17) The front opening 34 is formed in the device cover 33 of the wire saw, and the front opening 34 is continuously opened on upper and front sides of the supply pallet 67 and hence, the conveying-in operation and the conveying-out operation of the supply pallet 67 can be easily performed without causing any problems.

(18) In the workpiece machining method using the wire saw of this embodiment, the workpieces 49 are moved toward the wires 47 extending between the machining rollers 45 at the workpiece cutting position in a state where the workpieces 49 are arranged parallel to each other in an upright state. The workpiece 49 is cut by the wires 47, and the cut workpieces 49 are detained in the area inside the circulating region of the wires 47 while being kept in an upright state. Thereafter, the workpieces 49 are moved to the position outside the circulating region of the wires 47 from the area inside the circulating region of the wires 47 along the axial direction of the machining roller 45.

Accordingly, the cut workpieces 49 are conveyed out to the area outside the circulating region of the wires 47 from the area inside the circulating region of the wires 47 without causing interference between the workpieces 49 and wires 47 extending between the machining rollers 45 and hence, it is possible to prevent the cut workpieces 49 from being damaged due to contact between the workpiece 49 and the wires 47.

(19) The abandoning members 76 are adhered to the rear ends of the workpieces 49 in the conveying direction. By pushing out the abandoning members 76 by the push-out body 90, the workpieces 49 are conveyed toward the wires 47. Accordingly, by cutting to an extent that includes the position of the abandoning members 76, the workpieces 49 can be cut over the whole length thereof. By finishing the cutting at the position of the abandoning members 76, it is possible to prevent the push-out body 90 from being damaged by the wires 47.

(Modification)

This embodiment can be also embodied with the following modifications.

The number of machining rollers 45 may be set to two, three, five or more.

The wire saw may be configured such that workpieces 49 pass through wires 47 extending between a pair of machining rollers 45 arranged on upper and lower sides on an upstream side in the workpiece conveying direction, and also pass through wires 47 extending between a pair of machining rollers 45 arranged on upper and lower sides on a downstream side in the workpiece conveying direction. In this case, a receiving pallet 100 is arranged in an area outside a circulating region of the wires 47 extending between the machining rollers 45, and a guide passage for guiding the conveying of the workpieces 49 between a supply pallet 67 and the receiving pallet 100 is arranged in an area inside the circulating region of the wires 47.

A front upper portion of the device cover 33 may be opened only at an upper side of the supply pallet 67.

The configuration where machining rollers 45 are rotated by way of a chain driven by a motor may be adopted in place of the configuration where the machining rollers 45 are directly driven by the motor 48.

The configuration may be adopted where, of four machining rollers 45, only two machining rollers 45 on a left side (at the workpiece cutting position) are directly rotated by a motor and the two other machining rollers 45 are rotated as followers due to the circulation of wires 47. Alternatively, the configuration where, of four machining rollers 45, three machining rollers 45 including two machining rollers 45 on a left side are directly driven by a motor, and the other machining roller 45 is rotated as a follower due to the circulation of wires 47 may be also adopted.

EXPLANATION OF REFERENCE SIGNS

31: device frame, 32: device base, 33: device cover, 34: front opening (opening portion), 36: front door (door), 41: support bracket, 42: frame, 43: frame, 44: bridging member (reinforcing member), 45: machining roller, 46: annular groove, 47: wire, 48: motor, 49: workpiece, 53: roller piece, 56: guide roller unit, 57: guide roller, 67: supply pallet (workpiece guide part), 74: guide base, 75: workpiece guide member, 76: abandoning member, 77: workpiece restricting member, 87: ball screw, 88: motor, 89: movable member, 90: push-out body, 93: workpiece receiving part, 96: roller conveyer, 99: roller conveyer, 100: receiving pallet, 101: cylinder (conveying-out member), 741: bottom portion guide surface, 792: side portion guide surface

The invention claimed is:

1. A wire saw where a wire extends and is wound around a plurality of machining rollers, the wire is moved in a circulating manner around the machining rollers due to rotation of the machining rollers, and a plate-shaped workpiece is cut by the wire at a workpiece cutting position, the wire saw comprising:

a workpiece guide part, which guides the workpiece to move toward the wire at the workpiece cutting position along a workpiece conveying direction in an upright state; and a workpiece receiving part, which is arranged at a workpiece receiving position located downstream of the workpiece guide part in the workpiece conveying direction, and receives the workpiece cut by the wire with the workpiece kept in an upright state, wherein of the plurality of machining rollers, two machining rollers are arranged on an upper side and a lower side, respectively, at the workpiece cutting position, and the workpiece conveying direction is arranged to extend toward the workpiece cutting position along a horizontal direction, and the machining roller on a lower side is arranged downstream of the machining roller on an upper side in the workpiece conveying direction.

2. The wire saw according to claim 1, wherein the plurality of machining rollers is four machining rollers arranged at vertex positions of a quadrangular shape respectively.

3. The wire saw according to claim 2, wherein of the plurality of machining rollers, two machining rollers are arranged at the workpiece cutting position, and the wire saw includes two motors, which directly drive the two machining rollers, respectively.

4. The wire saw according to claim 2, further comprising a pair of frames, which face each other in an opposed manner, wherein the machining rollers are supported between the frames, and a reinforcing member, which extends parallel to an axis of the machining rollers, is made to extend between the frames in the vicinity of the respective machining rollers.

5. The wire saw according to claim 1, wherein the machining roller is constituted of a plurality of roller pieces detachably laminated in an axial direction thereof.

6. The wire saw according to claim 5, further comprising a guide roller for guiding the wire from one roller piece of the plurality of roller pieces to another roller piece of the plurality of roller pieces, wherein the guide roller is movable along the axial direction of the machining rollers.

7. The wire saw according to claim 6, wherein an inclination angle of an axis of rotation of the guide roller with respect to the axial direction of the machining rollers is adjustable.

8. The wire saw according to claim 2, wherein of the plurality of machining rollers, two machining rollers are arranged on an upper side and a lower side respectively at the workpiece cutting position, the workpiece conveying direction is arranged to extend toward the workpiece cutting position along the horizontal direction, and the workpiece guide part and the workpiece receiving part are arranged upstream and downstream of the workpiece cutting position, respectively, in the workpiece conveying direction.

9. The wire saw according to claim 1, wherein the workpiece guide part restricts the workpiece in an upright state by receiving one side surface of the workpiece and includes a side portion guide surface, which defines a workpiece guide direction, and a workpiece guide member, which elastically presses the workpiece against the side portion guide surface.

10. The wire saw according to claim 9, wherein a distance between the side portion guide surface and the workpiece guide member, which is arranged adjacent to the side portion guide surface, is adjustable.

11. The wire saw according to claim 1, wherein the workpiece guide part includes a restricting member, which is movable between a restricting position, which restricts the movement of the workpiece, and a retracting position at which the workpiece is retracted from the restricting position on a distal end of the workpiece in the workpiece conveying direction.

12. The wire saw according to claim 1, wherein the wire saw includes a device base, and the workpiece guide part is constituted of a pallet, which is detachable on the device base.

13. The wire saw according to claim 12, further comprising: a push-out device, which pushes out the workpiece on the pallet in the workpiece conveying direction.

14. The wire saw according to claim 13, wherein the push-out device includes a push-out body capable of coming into contact with a rear end of the workpiece in the workpiece conveying direction, and the workpiece is configured to be pushed out by the push-out body.

15. The wire saw according to claim 12, wherein the pallet includes a slip-down preventing member, which is movable between a slip-down preventing position, at which the slip-down preventing member prevents slippage of the workpiece when the pallet is inclined, and a retracting position at which the pallet is retracted from the slip-down preventing position.

16. The wire saw according to claim 1, further comprising: a conveying-out member for conveying the workpiece receiving part to an outside position from the workpiece receiving position along the axial direction of the machining rollers.

17. The wire saw according to claim 1, further comprising: a device cover, which covers the workpiece guide part and the workpiece receiving part, wherein the device cover includes: an opening portion, which is opened in front of the workpiece guide part and the workpiece receiving part and is opened at least above the workpiece guide part; and a door, which is capable of selectively opening or closing the opening portion.

18. A method of machining a workpiece using a wire saw where a wire extends and is wound around a plurality of machining rollers, the wire is moved in a circulating manner around the machining rollers due to rotation of the machining rollers, and a plate-shaped workpiece is cut by the wire at a workpiece cutting position, the method comprising the steps of:

moving the workpiece toward the wire at the workpiece cutting position along a workpiece conveying direction in an upright state and cutting the workpiece by the wire; and detaining the cut workpiece in an area inside a circulating region where the wire moves in a circulating manner while keeping the cut workpiece in an upright state and, thereafter, conveying out the cut workpiece to an outside position from the inside of the wire circulating region along an axial direction of the machining roller.

19. The method of machining a workpiece according to claim 18, wherein a member to be abandoned is adhered to a rear end of the workpiece in the workpiece conveying direction, and the workpiece is moved along the workpiece conveying direction by pushing the member to be abandoned.

20. A wire saw comprising:

a machining part where a workpiece is cut by a wire;

a workpiece guide part which supplies the workpiece to the machining part; and a device cover, which covers the machining part and the workpiece guide part, wherein the machining part and the workpiece guide part are arranged parallel to each other in the lateral direction, and the device cover includes an opening portion, which is opened in front of the machining part and the workpiece guide part; and a door, which selectively opens or closes the opening portion.

21. The wire saw according to claim 20, further comprising: a plurality of machining rollers around which the wire in the machining part is wound; and a plurality of motors, which drive the plurality of machining rollers individually, respectively, wherein the wire is moved in a circulating manner by rotating the machining rollers by the motors thus cutting the workpiece by the wire.

* * * * *